US006915600B2

(12) United States Patent
Kondou

(10) Patent No.: US 6,915,600 B2
(45) Date of Patent: Jul. 12, 2005

(54) HYDRAULIC CIRCUIT OF EXCAVATING AND SLEWING WORKING VEHICLE

(75) Inventor: Masami Kondou, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 0 days.

(21) Appl. No.: 10/380,146

(22) PCT Filed: Sep. 10, 2001

(86) PCT No.: PCT/JP01/07856

§ 371 (c)(1),
(2), (4) Date: Jun. 16, 2003

(87) PCT Pub. No.: WO02/22969

PCT Pub. Date: Mar. 21, 2002

(65) Prior Publication Data

US 2004/0083629 A1 May 6, 2004

(30) Foreign Application Priority Data

Sep. 12, 2000 (JP) ..... 2000-276201
Jun. 20, 2001 (JP) ..... 2001-187090

(51) Int. Cl.[7] ..... E02F 9/22
(52) U.S. Cl. ..... 37/414; 37/902
(58) Field of Search ..... 37/414, 902

(56) References Cited

U.S. PATENT DOCUMENTS 4,875,337 A * 10/1989 Sugiyama et al. ..... 60/421

FOREIGN PATENT DOCUMENTS

| | | |
|---|---|---|
| JP | 2760702 | 3/1998 |
| JP | 2767482 | 4/1998 |
| JP | 10-195933 | 7/1998 |
| JP | 2000-154805 | 6/2000 |

* cited by examiner

*Primary Examiner*—Meredith C. Petravick
(74) *Attorney, Agent, or Firm*—Knobbe, Martens, Olson & Bear LLP

(57) ABSTRACT

A hydraulic circuit of an excavating and slewing working vehicle of two pump system, wherein a directional control valve for slewing and a directional control valve for arm are tandem-connected to the upstream side and downstream side of the delivery oil passage of a second hydraulic pump, respectively, a directional control valve for bucket are connected to the delivery oil passage of a first hydraulic pump, and then a bleed switching valve connected, through a check valve between the directional control valve for slewing and the directional control valve for arm and switched to connect to or disconnect from a tank on the upstream side of the check valve and the directional control valve for slewing are operated interlockingly with each other.

12 Claims, 34 Drawing Sheets

Fig. 3
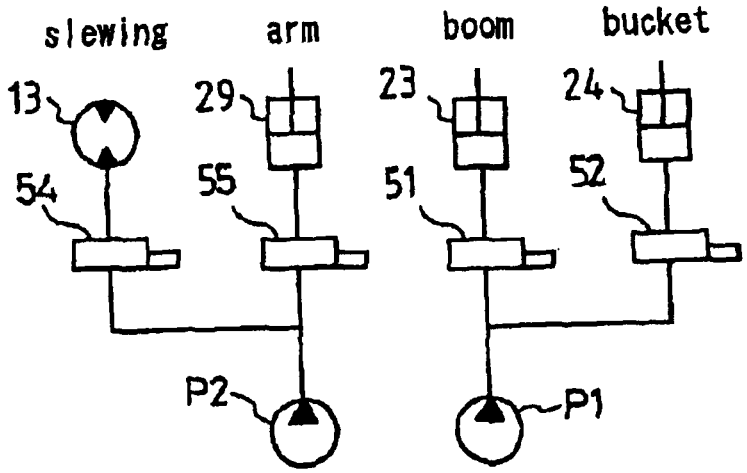
(a)
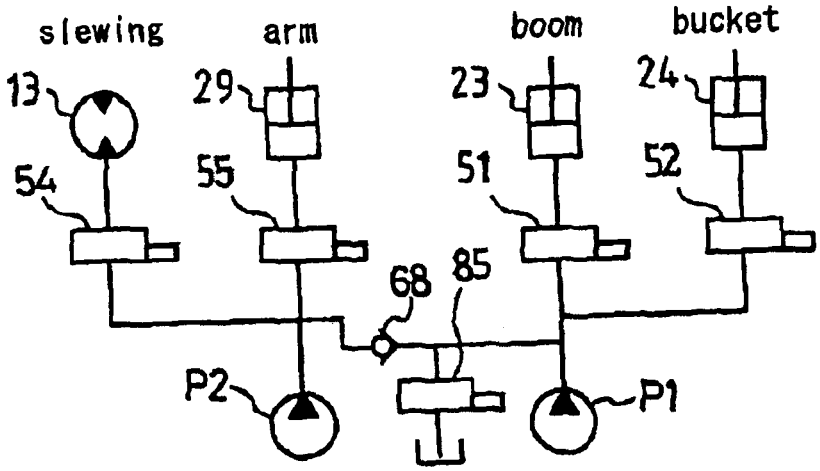
(b)

Fig. 16

101

☆The delivery passage of the first pump is connected to the delivery passage of the second pump through an orifice.
☆The bleed valve and the slewing directional control valve are interlocked with each other.

| Operation parts | Simultaneous operativity | |
|---|---|---|
| An arm and a bucket | Both of them are in respective independent circuits, thereby ensuring satisfactory simultaneous operativity. (the same as that of the conventional art) | ○ |
| A boom and a slewing body | Both of them are in respective independent circuits, thereby ensuring satisfactory simultaneous operativity. (the same as that of the conventional art) | ○ |
| An arm and a slewing body | Two pumps of the two independent circuits can be used so as to ensure the first pump drives the arm and the second pump drives the slewing body. | ○ |
| A boom, an arm and a slewing body | When directional control valves for the boom, the arm and slewing are operated simultaneously, the arm cylinder is not supplied with pressure oil, whereby the simultaneous operation of the three is impossible. | × |

Fig. 19

101a

☆The delivery passage of the first pump is connected to the delivery passage of the second pump through an orifice.

☆The bleed valve and the slewing directional control valve are interlocked with each other.

☆A bleed orifice is disposed in the oil passage between P and T ports in the slewing directional control valve.

| Operation parts | Simultaneous operativity | |
|---|---|---|
| An arm and a bucket | Both of them are in respective independent circuits, thereby ensuring satisfactory simultaneous operativity. (the same as that of the conventional art) | ○ |
| A boom and a slewing body | Both of them are in respective independent circuits, thereby ensuring satisfactory simultaneous operativity. (the same as that of the conventional art) | ○ |
| An arm and a slewing body | Two pumps of the two independent circuits can be used so as to ensure the first pump drives the arm and the second pump drives the slewing body. | ○ |
| A boom, an arm and a slewing body | Surplus flow to the flow fow slewing is supplied to the arm cylinder for driving the arm. However, drive speed of the arm is slow. | △ |

Fig. 22

101b

☆The delivery passage of the first pump is connected to the delivery passage of the second pump through an orifice.
☆The bleed valve and the slewing directional control valve are interlocked with each other.
☆A bleed orifice is disposed in the oil passage between P and T ports in the boom directional control valve.

| Operation parts | Simultaneous operativity | |
|---|---|---|
| An arm and a bucket | Both of them are in respective independent circuits, thereby ensuring satisfactory simultaneous operativity. (the same as that of the conventional art) | ○ |
| A boom and a slewing body | Both of them are in respective independent circuits, thereby ensuring satisfactory simultaneous operativity. (the same as that of the conventional art) | ○ |
| An arm and a slewing body | Two pumps of the two independent circuits can be used so as to ensure the first pump drives the arm and the second pump drives the slewing body. | ○ |
| A boom, an arm and a slewing body | Surplus flow to the flow fow the boom is supplied to the arm cylinder for driving the arm. However, drive speed of the arm is slow. | △ |

Fig. 25

101c

☆The delivery passage of the first pump is connected to the delivery passage of the second pump through an orifice.
☆The bleed valve and the slewing directional control valve are interlocked with each other.
☆A bleed orifice is disposed in the oil passage between P and T ports in the slewing directional control valve.
☆A bleed orifice is disposed in the oil passage between P and T ports in the boom directional control valve.

| Operation parts | Simultaneous operativity | |
|---|---|---|
| An arm and a bucket | Both of them are in respective independent circuits, thereby ensuring satisfactory simultaneous operativity. (the same as that of the conventional art) | ○ |
| A boom and a slewing body | Both of them are in respective independent circuits, thereby ensuring satisfactory simultaneous operativity. (the same as that of the conventional art) | ○ |
| An arm and a slewing body | Two pumps of the two independent circuits can be used so as to ensure the first pump drives the arm and the second pump drives the slewing body. | ○ |
| A boom, an arm and a slewing body | Surplus flow to the flow for slewing and surplus flow to the flew for the boom are supplied to the arm cylinder for driving the arm. | ○ |

Fig. 31

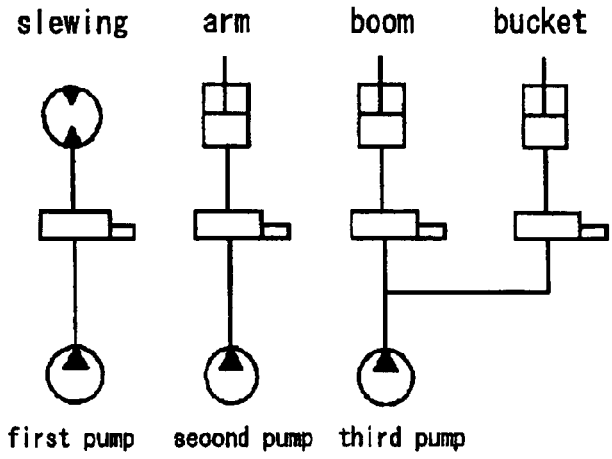

(a)

Conventional three pump system

| Operation parts | Simultaneous operativity | |
|---|---|---|
| An arm and a bucket | Both of them are in respective independent circuits, thereby ensuring satisfactory simultaneous operativity. | ○ |
| A boom and a slewing body | Both of them are in respective independent circuits, thereby ensuring satisfactory simultaneous operativity. | ○ |
| An arm and a slewing body | Both of them are in respective independent circuits, thereby ensuring satisfactory simultaneous operativity. | ○ |
| A boom, an arm and a slewing body | Both of them are in respective independent circuits, thereby ensuring satisfactory simultaneous operativity. | ○ |

(b)

Fig. 32

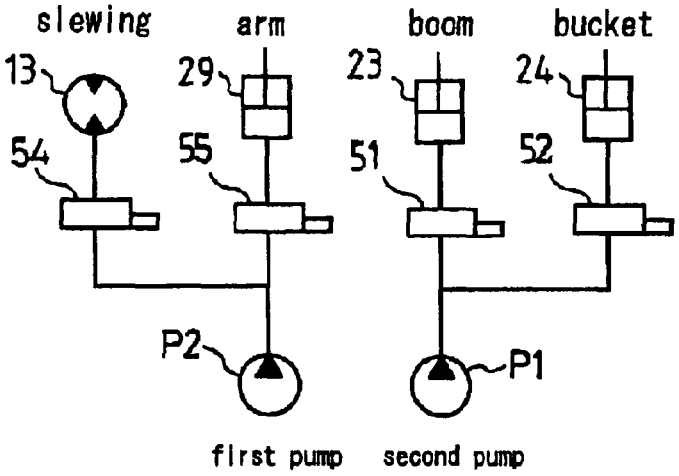

(a)

Conventional two pump system

| Operation parts | Simultaneous operativity | |
|---|---|---|
| An arm and a bucket | Both of them are in respective independent circuits, thereby ensuring satisfactory simultaneous operativity. | ○ |
| A boom and a slewing body | Both of them are in respective independent circuits, thereby ensuring satisfactory simultaneous operativity. | ○ |
| An arm and a slewing body | Only one of the arm and slewing body is driven. Or, both of them are driven, however operation speed thereof becomes slow. | × |
| A boom, an arm and a slewing body | Only one of the arm and slewing body is driven. Or, both of them are driven, however operation speed thereof becomes slow. | × |

(b)

Fig. 31 (a)

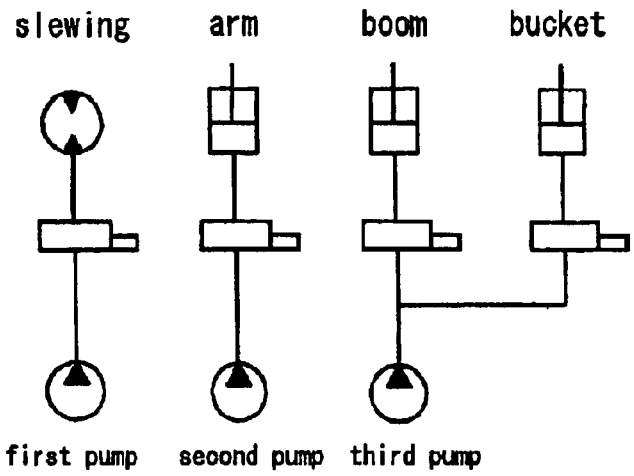

Prior Art

Fig. 31 (b)

Conventional three pump system

| Operation parts | Simultaneous operativity | |
|---|---|---|
| An arm and a bucket | Both of them are in respective independent circuits, thereby ensuring satisfactory simultaneous operativity. | ○ |
| A boom and a slewing body | Both of them are in respective independent circuits, thereby ensuring satisfactory simultaneous operativity. | ○ |
| An arm and a slewing body | Both of them are in respective independent circuits, thereby ensuring satisfactory simultaneous operativity. | ○ |
| A boom, an arm and a slewing body | Both of them are in respective independent circuits, thereby ensuring satisfactory simultaneous operativity. | ○ |

Prior Art

Fig. 32 (a)

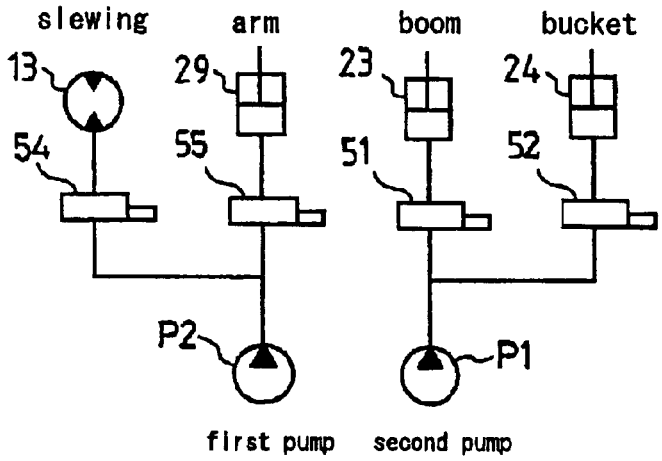

Prior Art

Fig. 32 (b)

Conventional two pump system

| Operation parts | Simultaneous operativity | |
|---|---|---|
| An arm and a bucket | Both of them are in respective independent circuits, thereby ensuring satisfactory simultaneous operativity. | ○ |
| A boom and a slewing body | Both of them are in respective independent circuits, thereby ensuring satisfactory simultaneous operativity. | ○ |
| An arm and a slewing body | Only one of the arm and slewing body is driven. Or, both of them are driven, however operation speed thereof becomes slow. | × |
| A boom, an arm and a slewing body | Only one of the arm and slewing body is driven. Or, both of them are driven, however operation speed thereof becomes slow. | × |

Prior Art

HYDRAULIC CIRCUIT OF EXCAVATING AND SLEWING WORKING VEHICLE

This application is the U.S. National Phase under 35 U.S.C. §371 of International Application PCT/JP01/07856, filed Sep. 10, 2001, which claims priority of Japanese Patent Application Nos. 2000-276201, filed Sep. 12, 2000, and 2001-187090, filed Jun. 20, 2001. The International Application was published under PCT Article 21(2) in a language other than English.

FIELD OF THE INVENTION

The present invention relates to a hydraulic circuit of a small excavating-and-slewing working vehicle of two pump system, which efficiently drives hydraulic actuators for driving work parts of a boom, an arm, a bucket and another (such as a blade), a hydraulic actuator for slewing a main body part, a pair of right and left actuators for traveling, and another hydraulic actuator. Especially, it relates to the hydraulic circuit which secures roadability (especially, translatory movability) of the vehicle at the time of operation of the work parts or the time of slewing during traveling of the vehicle, and secures such a simultaneous operativity of driving of the work parts and slewing of the vehicle body as to match up to a hydraulic circuit of three pump system.

BACKGROUND ART

A conventional excavating-and-slewing working vehicle includes respective hydraulic cylinders for driving working machines of a boom, an arm, a bucket and a bulldozing blade, a hydraulic cylinder for swinging a boom bracket, a hydraulic motor for slewing a main body of the vehicle, and a pair of right and left hydraulic motors for traveling, which are supplied pressure oil from a plurality of hydraulic pumps attached to an engine. Three or more hydraulic pumps are attached to a large-sized excavating-and-slewing working vehicle. A small-sized excavating-and-slewing working vehicle generally includes only two pumps because there is no space for juxtaposing many pumps in a small bonnet thereof. The actuator driving system of three pumps is called "three pump system", and that of two pumps is called "two pump system".

One of the hydraulic pumps of the two pump system may drive the hydraulic cylinder for boom, arm or the like together with the hydraulic motors for traveling simultaneously. Thus, if the boom, arm or the like is driven during traveling of the vehicle, either the hydraulic motors for traveling or the hydraulic cylinder, or both of them cannot be driven fully because the amount of pressure oil thereto is insufficient.

Japanese Patent No. 2,760,702 and Japan Patent Application Laid Open Gazette Hei. 10-195933 (sic), for example, disclose that pressure oil delivered from the two hydraulic pumps is controlled so as to ensure a sufficient amount of pressure oil.

As disclosed in Japanese Patent No. 2,760,702, a left traveling hydraulic motor, a bucket cylinder and a boom cylinder are essentially driven by one of the hydraulic pumps, and a right traveling hydraulic motor, an arm cylinder and an external hydraulic apparatus are by the other hydraulic pump. Bypass oil passages branch from the upstream (sic) side of the respective control valves for the traveling hydraulic motors and are provided with respective check valves so that each hydraulic pump can supply pressure oil to actuators essentially driven by the other hydraulic pump. However, pressure oil flows through each of the branch points into a lower-pressure side so as to collapse the driving balance among the driven actuators. For example, the vehicle unexpectedly turns left or right during its traveling.

Furthermore, this disclosed hydraulic circuit requires three parallel hydraulic passages. If the directional control valves are aligned in a stratified form so as to constitute a compact valve device, it is difficult for the valve device to make a space for arranging three common oil passages therein.

An art disclosed in Japan Patent Application Laid Open Gazette Hei. 10-195933 (sic) solves the problem of an excavating-and-slewing working vehicle that, when the boom is operated during traveling of the vehicle, a pressure difference may be is generated between the right and left traveling motors so as to disturb the translatory movability of the vehicle. A boom control valve is tandem-connected to the downstream side of the right and left traveling control valves. The two hydraulic pumps are connected at output sides thereof to each other through a bypass passage at the upstream side of the right and left traveling switching valves. The bypass passage is connected to the boom control valve through an orifice for pressure compensation.

However, only the boom actuator can be driven simultaneously with traveling drive of the vehicle without disturbing translatory movability. When the actuators for slewing, arm, bucket and PTO are driven during traveling of the vehicle, the vehicle cannot secure translatory movability, or unexpectedly turn left or right during traveling. Further, when working actuators are driven simultaneously, the activity of the driven actuators is unsatisfactory.

Furthermore, even if the vehicle excavates in the state of being stationary, there is impossible simultaneous operation of work parts for the conventional excavating-and-slewing working vehicle of two pump system. A general excavation cycle and the above-mentioned accompanying motions of actuators by an excavating-and-slewing working vehicle are shown in FIG. 2, which will be discussed in the later description of the present invention.

The excavation cycle comprises three stages, that is, excavation, soil-removal, and return-and-location. When work is started, a boom is moved downwardly and an end portion of a bucket is hit to the ground, and an arm and a bucket are simultaneously operated for excavation. Next, simultaneously with drive of the boom, a slewing body provided above a crawler type traveling equipment is slewed so that the vehicle turns to a side with the bucket holding soil, and the bucket is operated to damp the soil. Then, the arm and the slewing body are operated simultaneously, or the boom, the arm and the slewing body are operated simultaneously, so that the work machine is returned to the initial place and located.

As mentioned above, in the general excavation cycle of the excavating-and-slewing working vehicle, simultaneous operations of the arm and the bucket, of the boom and the slewing body, and of the arm and the slewing body or of the boom, the arm and the slewing body are performed.

The conventional three pump system has such a general construction as shown in FIG. 31(*a*) to supply pressure oil from the pumps to the actuators required for excavation. In this system, three pumps supply pressure oil to respective three actuators. Accordingly, as shown in FIG. 31(*b*), even if the boom, arm and slewing body are simultaneously operated, they obtain satisfactory activity.

On the other hand, the conventional two pump system has such a general construction as shown in FIG. 32(*a*) to supply pressure oil from the pumps to the actuators required for excavation. In this system, one pump supplies pressure oil to the slewing body and the arm, and the other to the boom and the bucket. The above-mentioned excavation cycle includes some operations requiring one pump to drive two actuators, e.g., simultaneous double operation of the arm and slewing body and simultaneous triple operation of the boom, arm and slewing body. Therefore, as shown in FIG. 32(*b*), two pump system is inferior to three pump system in some cases where two or more actuators are simultaneously operated. Thus, a current two pump system is adopted to only a small-sized excavating machine which does not consider high-workability seriously.

SUMMARY OF THE INVENTION

A main object of the present invention is to provide a hydraulic circuit structure for an excavating-and-slewing working vehicle of two pump system comprising hydraulic actuators (especially, hydraulic cylinders) for a boom, a bucket, slewing and a blade and hydraulic actuators (especially, hydraulic motors) for right and left traveling devices, which are driven by two hydraulic pumps that especially supply pressure oil to respective directional control valves for the left and right traveling actuators, wherein the hydraulic circuit structure holds satisfactory operative balance between two or more hydraulic actuators when they are actuated simultaneously.

A first sub object of the present invention is to provide the hydraulic circuit structure which surely and equally drives the pair of left and right traveling actuators while any of the hydraulic actuators for work is driven, thereby improving the straight roadability of the vehicle.

To achieve the object, according to the present invention, each of hydraulic oil supply passages from the hydraulic pumps bifurcates into a hydraulic oil passage to the corresponding left or right traveling directional control valve and a downstream oil passage. The downstream oil passages from the respective hydraulic pumps are connected to each other through respective check valves which prevent pressure oil from flowing backward to the respective hydraulic pumps, so as to form a confluent oil passage. Parallel hydraulic oil supply passages branch from the confluent oil passage through respective orifices to inhalation ports of the respective directional control valves for the hydraulic actuators for boom, bucket, slewing and arm.

Therefore, both the hydraulic motors for traveling are supplied with oil from the two hydraulic pumps and driven, prior to any of the hydraulic actuators for work and slewing other than them. When the vehicle travels during drive of any of the boom, the bucket and the arm, or during slewing of the vehicle body, priority is given to supply of oil for traveling. The other hydraulic actuators are suppressed in operativity because they are supplied pressure oil from the confluent oil passage on the downstream side of the hydraulic oil supply passage to the traveling hydraulic motors through the corresponding orifice. Accordingly, in case the vehicle travels while any of the hydraulic actuators other than the traveling hydraulic actuators is driven, satisfactory translatory movability of the vehicle can be secured.

In the above hydraulic circuit wherein the two hydraulic pumps supplies both the traveling actuators with oil for driving them prior to the hydraulic actuators for work and slewing other than the traveling actuators, a hydraulic oil supply passage also branches from the confluent oil passage to an inhalation port of a blade directional control valve for the hydraulic actuator for blade through an orifice. The branching point of the confluent oil passage to the blade directional control valve is located in the substantially middle point between the branch points of the hydraulic oil supply passage to both of the traveling directional control valves on the delivery oil passages of the hydraulic pumps. Accordingly, pressure losses of delivered oil from the hydraulic pumps become substantially equal to each other at the branching point of the hydraulic oil supply passage to the blade directional control valve on the confluent oil passage, thereby improving the translatory movability of the vehicle at work with the blade (for removing soil), for which the translatory movability is the most important.

Each of the delivery oil passages of the hydraulic pumps bifurcates on the upstream side of the corresponding check valve so as to form a center bypass oil passage. The center bypass oil passages from the respective delivery oil passages pass the directional control valves for boom, bucket, slewing and arm in series to an oil tank when the valves are neutral. The inhalation port of each of the directional control valves is also connected through a hydraulic oil supply passage to a portion of any of the center bypass oil passages on the primary side of the directional control valve. Therefore, when the vehicle is stationary and one of the actuators for boom, bucket, slewing and arm is driven, priority is given to supply of hydraulic oil from the center bypass oil passages to the actuator over supply of hydraulic oil from the confluent oil passage to the actuator through the orifice. As a result, the pressure oil from the center bypass oil passage and the pressure oil from the confluent oil passage through the orifice are supplied as hydraulic oil for the actuator, thereby ensuring fine operavility of the actuator.

One of the center bypass oil passages is enabled to pass the boom directional control valve for boom and then pass the bucket directional control valve for bucket in straight. On each of the one center bypass oil passage and the confluent oil passage, a branch point of the hydraulic oil supply passage to the boom directional control valve is positioned on the upstream side of the branch point of the hydraulic oil supply passage to the boom directional control valve. When the boom and the bucket are operated simultaneously, larger load (pressure) is applied to the boom which is heavier than the bucket. However, the boom having larger load is supplied with hydraulic pressure from the one center bypass oil passage without going through an orifice. On the other hand, the bucket having smaller load is supplied with hydraulic pressure from only the confluent oil passage through the orifice. Accordingly, even if the mass of the boom is different from that of the bucket, hydraulic pressure can be balanced and speed balance can be maintained between the boom and the bucket.

One of the center bypass oil passages is enabled to pass the slewing directional control valve for slewing and then pass the arm directional control valve for arm in straight. On each of the one center bypass oil passage and the confluent oil passage, a branch point of the hydraulic oil supply passage to the slewing directional control valve is positioned on the upstream side of the branch point of the hydraulic oil supply passage to the arm directional control valve. When stewing of the vehicle body and operation of the arm are performed simultaneously, the stewing motor with large inertia force, causing large load at the time of acceleration, is supplied with hydraulic pressure from the second hydraulic pump through the one center bypass oil passage without going through an orifice. On the other hand, the arm having smaller load is supplied with only hydraulic pressure from the first hydraulic pump through the parallel oil passages and the orifice. Accordingly, the stewing and the operation of arm are balanced with each other.

One of the center bypass oil passages may be called a first center bypass oil passage, and the other a second center bypass oil passage. The first center bypass oil passages is enabled to pass the boom directional control valve and the bucket directional control valve in series, and the directional control valves are supplied with hydraulic oil from the first center bypass oil passage. The second center bypass oil passage is enabled to pass the stewing directional control valve and the arm directional control valve in series, and the directional control valves are supplied with hydraulic oil from the second center bypass oil passage. Accordingly, the boom and the bucket are driven by one of the hydraulic pumps, and the stewing body and the arm are driven by the other hydraulic pump, thereby constituting substantially independent circuits so as to ensure simultaneous operativity of any two actuators, e.g., those for boom and stewing, for bucket and stewing, for arm and boom, or for bucket and arm.

The furthest downstream end of the first center bypass oil passage is connected to the second center bypass oil passage on the primary side of the arm directional control valve (between the stewing directional control valve and the arm directional control valve). Accordingly, the arm directional control valve is supplied with pressure oil from the two hydraulic pumps so that the resultant confluent pressure oil raises drive speed of the arm. A check valve is interposed in a portion of the first center bypass oil passage on the upstream side of the furthest downstream end of the first center bypass oil passage, and a bleed oil passage having an orifice branches from the first center bypass oil passage on the upstream side of the check valve to the second center bypass oil passage on the downstream side of the arm directional control valve. Therefore, the flux from the first center bypass oil passage to the arm directional control valve can be controlled so as to regulate the drive speed of the arm. At the time of simultaneous operation of the arm together with the boom or the bucket, the check valve prevents the pressure oil flowing in the second center bypass oil passage from falling to the bleed oil passage (or the orifice thereof), thereby surely supplying the pressure oil for driving the arm.

The second center bypass oil passage is enabled to pass a PTO directional control valve for PTO on the downstream side of the arm directional control valve. An inhalation port of the PTO directional control valve is connected to a hydraulic oil supply passage branching from the confluent oil passage. A breaker (rock drill) is hardly used at the time of traveling or excavating work (with operating the boom, the arm and the bucket and slewing), but it is driven alone. The breaker needs hydraulic oil of large flux. The PTO directional control valve is supplied with hydraulic oil from the confluent oil passage without going through an orifice, thereby supplying the pressure oil from both the hydraulic pumps to the breaker with minimum pressure loss so as to improve the working efficiency.

The bleed oil passage from the first center bypass oil passage is connected to the second center bypass oil passage between the arm directional control valve and the PTO directional control valve, thereby joining pressure oil of the first center bypass oil passage to pressure oil of the second center bypass oil passage and ensuring an amount of hydraulic pressure required for PTO work.

Under the above-mentioned main object of the present invention to provide a hydraulic circuit structure for holding satisfactory operative balance between two or more simultaneously driven hydraulic actuators, a second sub object of the present invention is to the hydraulic circuit enabling satisfactory simultaneous operations of both the arm and the slewing body and of all the bucket, the arm and the slewing body. These simultaneous operations are impossible for the conventional hydraulic circuit of two pump system, which drives the boom and bucket by one of the pumps, and drives the arm and the slewing body by the other pump. A hydraulic circuit of three pump system enables the simultaneous operations.

Therefore, according to the present invention, a hydraulic circuit of an excavating-and-slewing working vehicle is provided with actuators for a boom, a bucket, slewing and an arm driven by supplying pressure oil from a first hydraulic pump and a second hydraulic pump through respective directional control valves. A delivery oil passage of the first hydraulic pump connects the boom directional control valve for boom to the bucket directional control valve for bucket on the downstream side of the boom directional control valve in tandem. The delivery oil passage of the second hydraulic pump connects the slewing directional control valve for slewing to the arm directional control valve for arm in tandem. The delivery oil passage of the first hydraulic pump passes the bucket directional control valve and is connected to a portion of the delivery oil passage of the second hydraulic pump between the slewing directional control valve and the arm directional control valve through a check valve. A bleed circuit branches from the delivery oil passage of the first hydraulic pump on the upstream side of the check valve so as to be opened and closed in relation to switching of a further upstream located one of the slewing directional control valve and the arm directional control valve.

When the slewing directional control valve and the arm directional control valve are in their actuating position, the upstream located directional control valve is supplied with oil delivered from the second hydraulic pump. Although the oil delivered from the second hydraulic pump is prevented from flowing to the other downstream located directional control valve, the bleed circuit is closed so as to supply not-bled oil delivered from the first hydraulic pump to the other downstream located directional control valve. Accordingly, the hydraulic actuator for arm is driven by oil delivered from one of the hydraulic pumps, and the hydraulic actuator for slewing is driven by oil delivered from the other hydraulic pump. Thus, this structure enables the simultaneous operation of the arm and the slewing body, which the conventional hydraulic circuit of two pump system does not enable, or if possible, in the state that one of them is insufficiently operated.

To construct the bleed circuit which is opened and closed in relation to setting of the upstream located directional control valve, the bleed circuit may pass the upstream located directional control valve so that it is opened when the upstream located directional control valve in its neutral position, and closed when the upstream located directional control valve is in its actuating position. Due to this, the bleed circuit can be provided with an opening and closing valve structure by improvement of the upstream located directional control valves without providing such an additional valve member as to require a space for arrangement.

Furthermore, an orifice may be constructed in the portion of the bleed circuit within the upstream located directional control valve constructed as mentioned above. Accordingly, when one of the hydraulic actuators for slewing and arm, which corresponds to the other downstream located directional control valve, is driven alone, oil delivered from the first hydraulic pump is bled, while being controlled in its amount, to be joined to oil delivered from the second hydraulic pump, and this resultant confluent oil is supplied to this actuator.

To provide a simple and economic orifice in the directional control valve, a spool for opening and closing the bleed circuit may be assembled therein. Only exchanging the spool can easily perform the change of open degree of the orifice for adjusting the drive speed of the hydraulic actuator.

Alternatively, instead of the above-mentioned improvement of the directional control valve, a bleed switching valve interlocking with the upstream located one of the slewing directional control valve and the arm directional control valve may be interposed in the bleed circuit. Without improving the directional control valve, the simultaneous operation of the slewing body and the arm, which is not enabled by the conventional two pump system, is enabled by addition of the bleed switching valve and an interlocking cooperation structure between the bleed switching valve and the upstream located directional control valve.

An orifice may be constructed in the portion of the bleed circuit within the bleed switching valve. Accordingly, when one of the hydraulic actuators for slewing and arm, which corresponds to the other downstream located directional control valve, is driven alone, oil delivered from the first hydraulic pump is bled, while being controlled in its amount, to be joined to oil delivered from the second hydraulic pump, and this resultant confluent oil is supplied to this actuator so as to drive it swiftly.

The interlocking cooperation of the bleed switching valve and the upstream located directional control valve may be ensured by providing hydraulic pilot type switching valves, which serve as the upstream located directional control valve and the bleed switching valve, and a pilot oil passage, which connects a pilot operation valve for controlling hydraulic pilot of the upstream located directional control valve with a pilot operating portion the upstream located directional control valve and branches another pilot oil passage therefrom to a pilot operating portion the bleed switching valve.

Additionally, a high-pressure selection valve may be provided in the pilot passage connecting the pilot operation valve with the upstream located directional control valve of upstream side, and the pilot oil passage to the bleed switching valve may branch from the high-pressure selection valve, so as to interlockingly connect the two switching position type bleed switching valve to the three switching position type upstream located directional control valve.

An oil passage from a T port of the further downstream located one of the slewing directional control valve and the arm directional control valve always passes the bleed switching valve so as to supply a PTO directional control valve with hydraulic oil from a portion thereof on the downstream side of the bleed switching valve. Accordingly, at the time of driving a PTO drive actuator, by setting the other actuators to the neutral state, pressure oil from the first hydraulic pump and pressure oil from the second hydraulic pump can be joined with each other and supplied to the PTO drive actuator, thereby ensuring satisfactory operativity of the PTO drive work machine.

Furthermore, the boom directional control valve may be so constructed that P and T ports thereof, which are connected with each other when the boom directional control valve is in its neutral position, are connected with each other through an orifice when the boom directional control valve is in its actuating position. Therefore, even when the boom is operated, oil delivered from the first hydraulic pump flows to the downstream side of the boom directional control valve and is joined to oil delivered from the second hydraulic pump. Accordingly, hydraulic oil from the first hydraulic pump flows to the further downstream one of the slewing directional control valve and the arm directional control valve with respect to the second hydraulic pump, whereby the two pump system, as well as the three pump system, can simultaneously carry out three operations of drive of the arm and the boom, and slewing of the slewing body.

Alternatively, P and T ports of the further upstream located one of the slewing directional control valve and the arm directional control valve, which are connected with each other when the boom directional control valve is in its neutral position, may be connected with each other through an orifice when the boom directional control valve is in its actuating position. Therefore, when the upstream located directional control valve is set in its actuating position, a part of hydraulic oil from the second hydraulic pump also flows to the other downstream directional control valve. Accordingly, even when the boom (or the bucket) is driven and oil delivered from the first hydraulic pump does not reach the delivery oil passage of the second hydraulic pump, the downstream located directional control valve is supplied with oil delivered from the second hydraulic pump, whereby the two pump system, as well as the three pump system, can simultaneously carry out three operations of drive of the arm and the boom, and slewing of the slewing body.

Further, since the boom directional control valve, or the upstream located one of the slewing directional control valve and the arm directional control valve is provided with the above-mentioned orifice, the simultaneous operations of three hydraulic actuators are equalized so as to ensure the satisfactory simultaneous operativity.

These, other and further objects, features and advantages of the present invention will appear more fully in the following description accompanied with drawings.

BRIEF DESCRIPTION OF THE DRAWINGS

FIG. 3 illustrates schematic diagrams, each of which shows an essential hydraulic oil circuit structure of two pump system including hydraulic supply oil circuits for a boom cylinder 23, an arm cylinder 29, a bucket cylinder 24 and a slewing motor 13 according to the present invention, wherein (a) shows a circuit structure comprising two essential independent circuits, and (b) shows the circuit structure additionally provided with a bleed circuit (especially, as to a hydraulic circuit structure 101 of FIG. 10) for confluence and exchange of hydraulic oil between the two independent circuits.

FIG. 16 is a table of a list about applicability of simultaneous activity among the arm 5, the bucket 4 and the boom 6, and a slewing body 8 according to the hydraulic circuit 101 (sic).

FIG. 19 is a table of a list about applicability of simultaneous activity among the arm 5, the bucket 4 and the boom 6, and the slewing body 8 according to the hydraulic circuit 101*a*.

FIG. 22 is a table of a list about applicability of simultaneous activity among the arm 5, the bucket 4 and the boom 6, and the slewing body 8 according to the hydraulic circuit 101*b*.

FIG. 25 is table of a list about applicability of simultaneous activity among the arm 5, the bucket 4 and the boom 6, and the slewing body 8 according to the hydraulic circuit 101*c*.

FIG. 31 illustrates a conceptual diagram of a conventional hydraulic circuit of three pump system and a table of a list about applicability of simultaneous activity of parts according to the hydraulic circuit of three pump system.

FIG. 32 illustrates a conceptual diagram of a conventional hydraulic circuit of two pump system and a table of a list about applicability of simultaneous activity of parts according to the hydraulic circuit of two pump system.

BEST MODE FOR CARRYING OUT THE INVENTION

Figure 1:
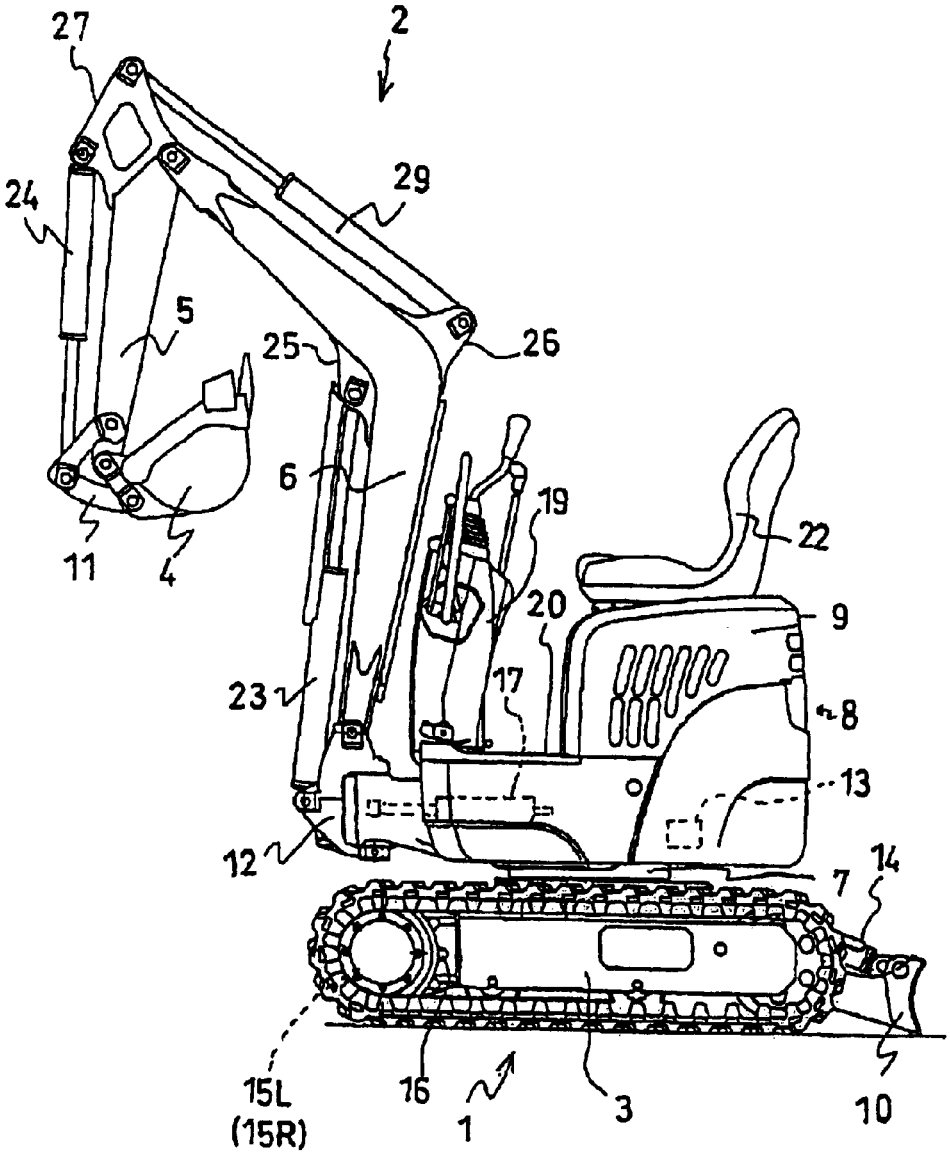
FIG. 1 is an entire side view of an excavating-and-slewing working vehicle having a hydraulic circuit of two pump system according to the present invention.

First, description will be given on a general construction of a small excavating-and-slewing working vehicle according to the present invention. As shown in FIG. 1, the slewing working vehicle is so constructed that a slewing body 8 is rotatably supported by an upper center portion of a crawler type traveling equipment 1 through a slewing body mount bearing 7. A blade 10 for removing soil is vertically rotatably supported by a front or rear end portion of the crawler type traveling equipment 1. In this embodiment, the blade 7 is disposed on the rear end thereof.

A bonnet 9 covering an engine is disposed on an upper portion of the slewing body 8 (sic). A seat 22 is disposed on an upper surface of the bonnet 9. Levers for driving operation are disposed on a front column 19 ahead of the seat 22. A floor board 20 is arranged between the front column 19 and the bonnet 9.

A boom bracket 12 is laterally rotatably disposed on a front end portion of the slewing body 8. A lower end portion of a boom 6 is longitudinally rotatably supported by the boom bracket 12. The boom 6 is bent forwardly at its middle portion and substantially doglegged when viewed in side. An arm 5 is rotatably supported by an upper end portion of the boom 6. A bucket 4 as an attachment for work is rotatably supported by an utmost end portion of the arm 5. A breaker (rock drill) may replace the bucket 4. In this case, pressure oil is supplied to the breaker through later-discussed PTO ports. A work machine 2 is comprised of the boom 6, the arm 5, the bucket 4 and the like.

The boom 6 is rotated by a boom cylinder 23. The arm 5 is rotated by an arm cylinder 29. The bucket 4 is rotated by a bucket cylinder 24.

Hydraulic cylinders serve as the boom cylinder 23, the arm cylinder 29 and the bucket cylinder 24. The cylinders 23, 29 and 24 are driven in a telescoping manner by supplying pressure oil from later-discussed hydraulic pumps disposed in the bonnet 9 of the slewing body 8 through directional control valves, hydraulic hoses or the like.

The boom cylinder 23 is infixed between the boom bracket 12 and a boom cylinder bracket 25 disposed on the front surface of the middle portion of the boom. The arm cylinder 29 is infixed between an arm cylinder bottom bracket 26 disposed on the rear surface of the middle portion of the boom and a bucket cylinder bracket 27 disposed on the basal end portion of the arm. The bucket cylinder 24 is infixed between the bucket cylinder bracket 27 and a stay 11 connected to the bucket.

A swing cylinder 17 is disposed on a lower portion of the slewing body 8, and a basal portion of the cylinder 17 is pivoted on a slewing body 8 (sic). An utmost end of a cylinder rod of the swing cylinder 17 is connected to the boom, bracket 12. The boom bracket 12 is enabled to rotate laterally relative to the slewing body 8 by the swing cylinder 17. Accordingly, the work machine 2 can be rotated laterally.

The slewing body 8 can be rotated laterally 360 degrees by driving a slewing hydraulic motor 13 disposed on an upper portion of the slewing body mount bearing 7. The blade 10 can be moved vertically by driving a blade cylinder 14 extended from a track frame 3 of the crawler type traveling equipment 1. Each of right and left traveling hydraulic motors 15R and 15L is disposed on the inside of each of right and left drive sprockets 16 disposed on a front or rear end portion of the track frame 3. The motors 15R and 15L drive the crawler type traveling equipment 1 for traveling.

The hydraulic cylinders and the hydraulic motors serving as hydraulic actuators are controlled by operation of levers and pedals disposed on the front column 19 and the step 20. The actuators may be controlled automatically.

Figure 2:
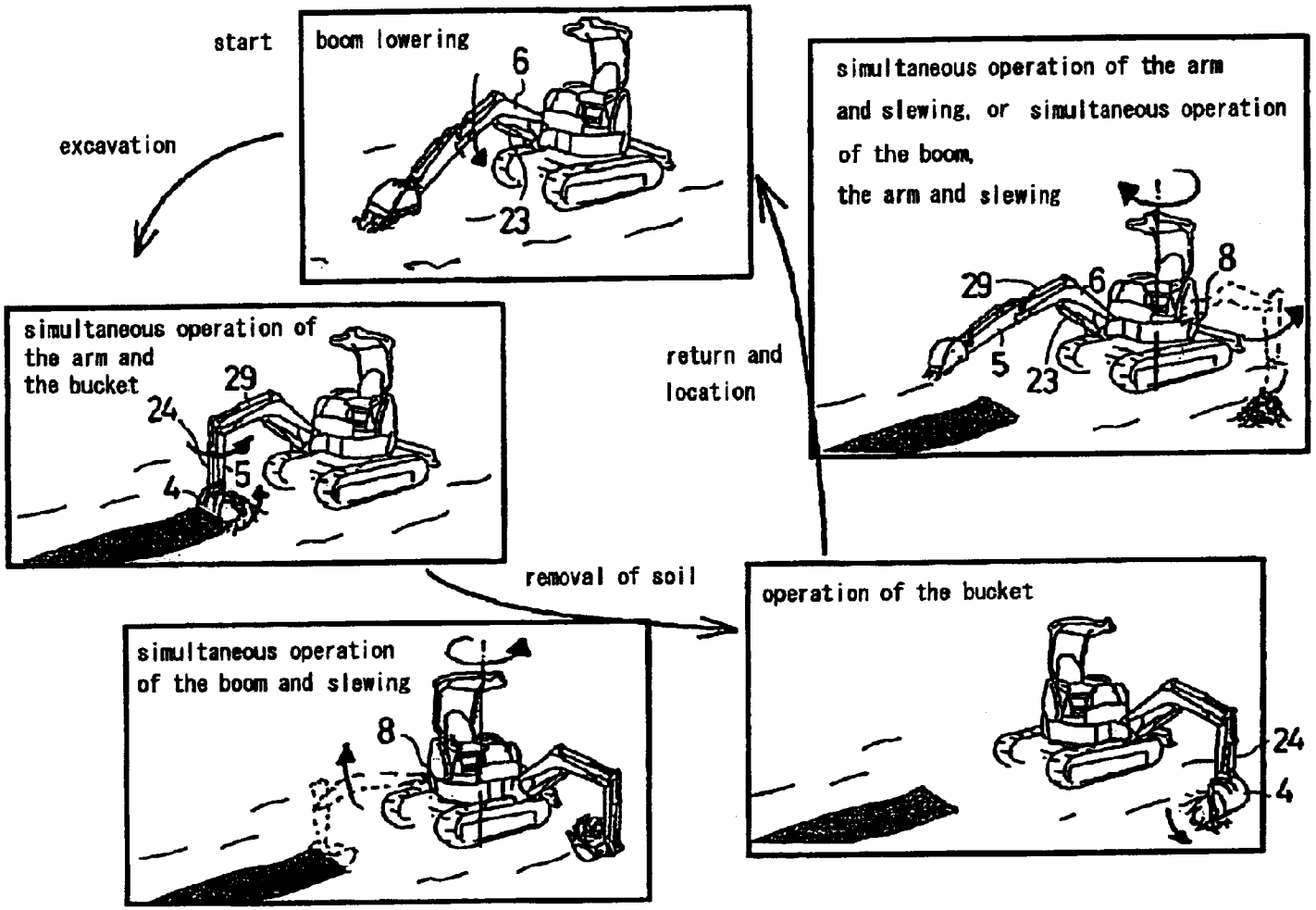
FIG. 2 is a schematic diagram showing a general excavation cycle and motions of parts of the excavating-and-slewing working vehicle.

A general excavation cycle with the excavating-and-slewing working vehicle and motions of the actuators accompanying the cycle are shown in FIG. 2.

The excavation cycle comprises three stages of excavation, removal of soil, and return-and-location. When work is started, boom 6 is moved downwardly and the end portion of the bucket 4 is hit to the ground, and the arm 5 and the bucket 4 are simultaneously operated for excavation. Next, drive of the boom 6 and slewing movement of the slewing body 8 provided above the crawler type traveling equipment 1 are simultaneously done so that the bucket 4 holding the soil turns to a side, and the bucket 4 is operated to dump the soil. Then, drive of the arm 5 and the slewing movement are operated simultaneously, or the boom 6, the arm 5 and the slewing movement are operated simultaneously, so as to return the work machine to the initial excavated place and locate the work machine.

As mentioned above, in the general excavation cycle by the excavating-and-slewing working vehicle, simultaneous driving operations of the arm 5 and the bucket 4, of the boom 6 and the slewing body 8, and of the arm 5 and the slewing body 8 or of the boom 6, the arm 5 and the slewing body 8 are performed.

A common basic object of later-discussed various embodiments is to fulfill such a minimum requirement as to ensure the simultaneous double-actuator operations among all simultaneous actuator operations which are necessary for the excavation work.

More specifically, all of later-discussed hydraulic circuits especially concern to drive of the boom cylinder 23, the bucket cylinder 24, the arm cylinder 29 and the slewing motor 13 as basic hydraulic actuators. Basically, each of the hydraulic circuits is so constructed that a first hydraulic pump P1 supplies hydraulic oil to the boom cylinder 23 and the bucket cylinder 24, and a second hydraulic pump P2 supplies hydraulic oil to the arm cylinder 29 and the slewing motor 13, as shown in FIG. 3. Namely, each of the two hydraulic motors P1 and P2 specifies the hydraulic actuators to which it supplies hydraulic oil. Scilicet, the hydraulic pumps constitute respective independent circuits.

Accordingly, in such basic cases that either the boom 6 or the bucket 4 is driven simultaneously with drive of the arm 5, and that either the boom 6 or the bucket 4 is driven simultaneously with slewing of the slewing body 8, the simultaneously driven actuators are properly operated because they are supplied with hydraulic oil independently from the hydraulic pumps P1 and P2 so as to obtain respective proper driving forces.

The arm cylinder 29, which especially has to be swiftly operated, is supplied with pressure oil from the second hydraulic pump P2 to which pressure oil from the first hydraulic pump P1 is joined. In this case, to prevent the arm cylinder 29 from being excessively supplied with hydraulic oil, pressure oil from the first hydraulic pump P1 supplied to the arm cylinder 29 is regulated by a bleed circuit before it is joined to the pressure oil from the second hydraulic pump P2. FIG. 3(*b*) is a schematic diagram showing a case that hydraulic oil is supplied from the first hydraulic pump P1 to the arm cylinder 29 by use of the bleed circuit comprising a bleed switching valve 85 and a check valve 68 and provided in a later-discussed hydraulic circuit 101 shown in FIGS. 10 and 13.

In the case that the slewing motor 13 is driven simultaneously with the arm cylinder 29 (the case that slewing of the slewing body 8 and drive of the arm 5 are done simultaneously), oil delivered from the second hydraulic pump P2 is supplied to the slewing motor 13, and pressure oil from the first hydraulic pump P1 is supplied to the arm cylinder 29. Accordingly, simultaneous activity of the hydraulic actuators 13 and 29 is also secured.

Hereinafter, a hydraulic circuit 100 shown in FIGS. 4 to 7 and the hydraulic circuit 101 shown in FIGS. 10 and 16 will be described as basic hydraulic circuits for driving the hydraulic cylinders and the hydraulic motors constituting the hydraulic actuators of the excavating-and-slewing working vehicle. A hydraulic circuit 100*a* shown in FIG. 8 and a hydraulic circuit 100*b* shown in FIG. 9 will be described as modification examples of the hydraulic circuit 100. A hydraulic circuit 101*a* shown in FIGS. 17 and 19, a hydraulic circuit 101*b* shown in FIGS. 20 and 22, a hydraulic circuit 101*c* shown in FIGS. 23 and 25, a hydraulic circuit 101*d* shown in FIGS. 26 and 27, a hydraulic circuit 101*e* shown in FIG. 28, a hydraulic circuit 101*f* shown in FIG. 29 and a hydraulic circuit 10l*g* shown in FIG. 30 will be described as modification examples of the hydraulic circuit 101.

More specifically, the hydraulic circuit 100, and the hydraulic circuits 100*a* and 100*b* as modification examples of the hydraulic circuit 100 do not achieve the simultaneous triple-actuator operation for the boom, the arm and the slewing body as shown in FIG. 2, however, they achieve the above-mentioned simultaneous double-actuator operations. Additionally, they ensure the simultaneous operation of the boom 6 and the bucket 4 connected in the same independent circuit. A further object of these circuits is to secure traveling power and translatory movability when the vehicle travels with operation of the actuators other than the traveling motors 15L and 15R.

Based on the hydraulic circuit 101 securing the simultaneous operativity of two of the actuators, the hydraulic circuits 101*a*, 101*b*, 101*c*, 101*d*, 101*e*, 101*f* and 101*g* as modification examples of the hydraulic circuit 101 are provided to improve the simultaneous operativity of the drive of the arm and the slewing body, and to secure the simultaneous operativity of the three of the boom, the arm and the slewing body.

Assuming the above, description will be given on the hydraulic circuit 100 according to FIGS. 4 to 7.

Figure 4:
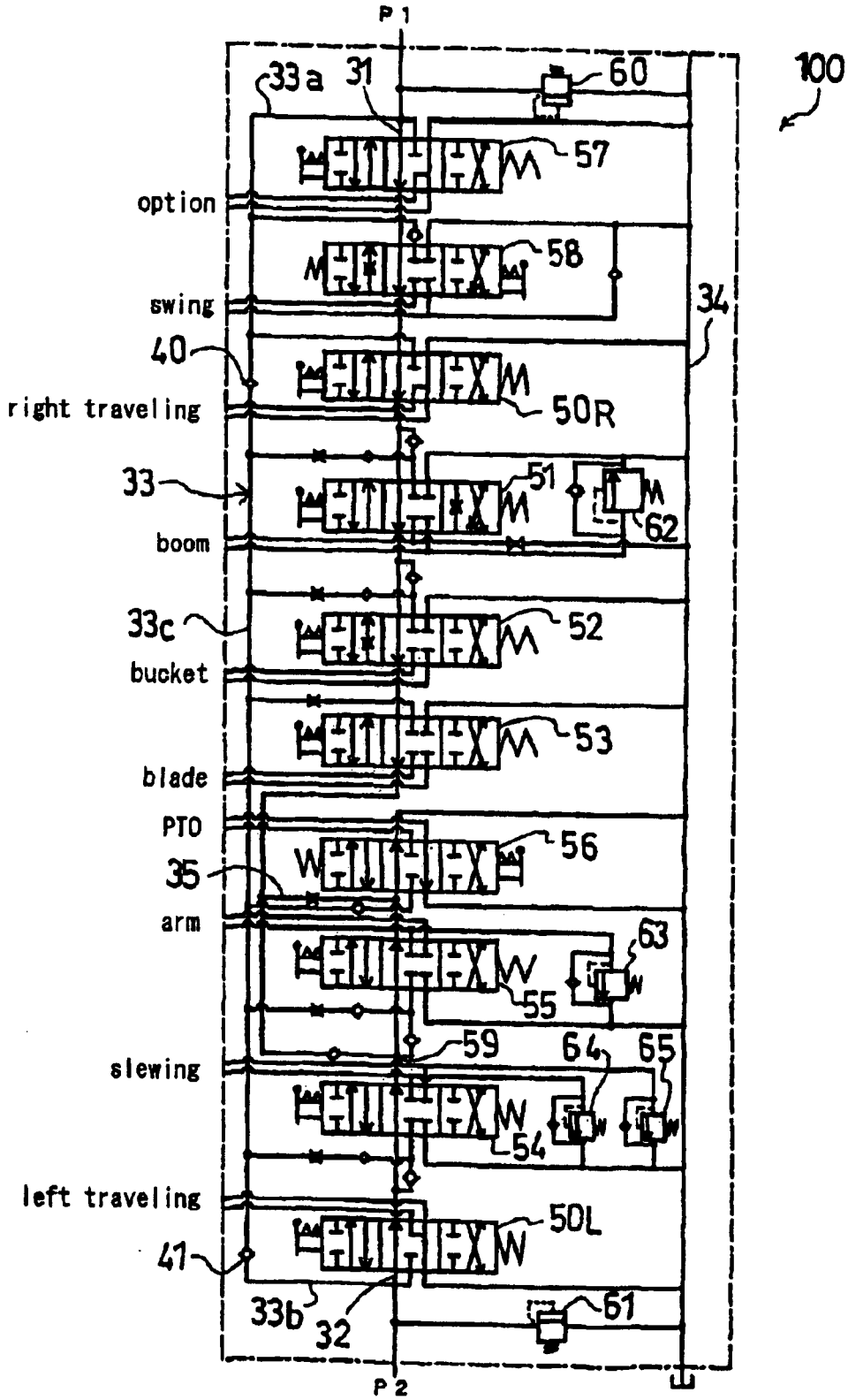
FIG. 4 is a circuit diagram of a hydraulic circuit 100 of an excavating-and-slewing working vehicle according to the present invention, constructed to give priority to drive of traveling motors over drive of a boom, a bucket and an arm and slewing drive of a slewing body.

The first hydraulic pump P1 and the second hydraulic pump P2 are driven by the engine disposed in the bonnet 9. As shown in FIG. 4, a tank oil passage 34 is always connected to an oil tank. A relief valve 60 is interposed between the delivery oil passage of the first hydraulic pump P1 and the tank oil passage 34, and a relief valve 61 between the delivery oil passage of the second hydraulic pump P2 and the tank oil passage 34. These relief valves 60 and 61 regulate hydraulic pressure of oil delivered from the hydraulic pumps P1 and P2.

As shown in FIG. 4, the delivery oil passage of the first hydraulic pump P1 passes a passage branching therefrom to the relief valve 60, and trifurcates into a hydraulic oil supply passage to an inhalation port of an optional directional control valve 57 for an optional equipment actuator, a first center bypass oil passage 31, and a branch oil passage 33*a* of a parallel oil passage 33.

The first center bypass oil passage 31 is constructed by connecting in series (arranged in tandem) the option directional control valve 57, a swing directional control valve 58, the directional control valve 50R for one of the right and left traveling motors (in this embodiment, for the right traveling motor 15R), a boom directional control valve 51, a bucket directional control valve 52 and a blade directional control valve 53 from the upstream. As shown in FIG. 4, when all of the directional control valves are in their neutral positions, all of the valves are opened and oil from the first hydraulic pump P1 passes the directional control valves 57, 58, 50R, 51, 52 and 53 of this oil passage 31. A portion of the first center bypass oil passage 31 on the downstream side of the blade directional control valve 53 is connected to a second hydraulic pump side center bypass oil passage 32 as discussed later so that oil delivered from the first hydraulic pump P1 through the blade directional control valve 53 is joined to the second hydraulic pump side center bypass oil passage 32.

The delivery oil passage of the second hydraulic pump P2 passes an oil passage branching therefrom to the relief valve 61, and trifurcates into a hydraulic oil supply passage to an inhalation port of a directional control valve 50L for the other of the right and left traveling motors (in this embodiment, for the left traveling motor 15L), the second hydraulic pump side center bypass oil passage 32, and a branch oil passage 33*b* of the parallel oil passage 33.

The second hydraulic pump side center bypass oil passage 32 is constructed by connecting in series (arranged in tandem) the directional control valve 50L for the right traveling motor 15R, a slewing directional control valve 54, an arm directional control valve 55 and a PTO directional control valve 56 from the upstream. When all of the directional control valves are in their neutral positions, all of the valves are opened so that oil from the second hydraulic pump P2 (sic) passes the directional control valves 50L, 54, 55 and 56 of this oil passage 32 and is drained to the tank oil passage 34.

Figure 7:
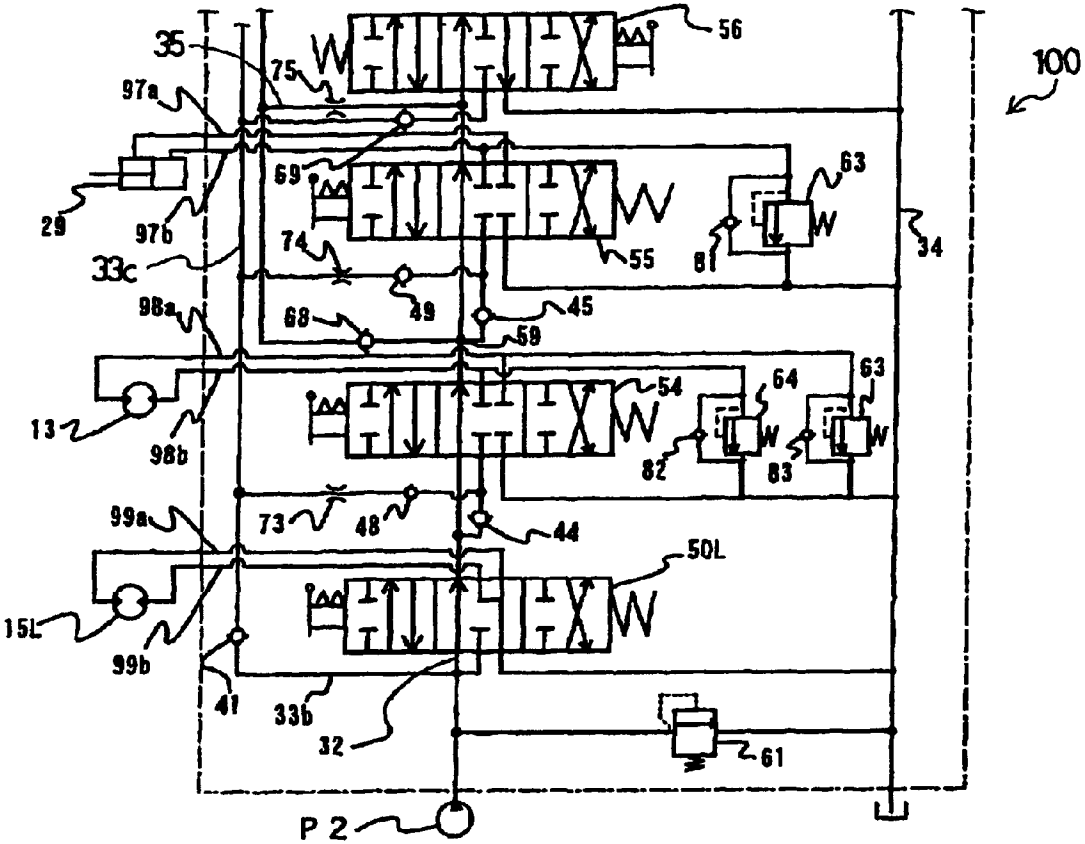
FIG. 7 is an enlarged circuit diagram of a second pump side portion of the hydraulic circuit 101.

As shown in FIG. 7, the furthest downstream end portion (on the downstream side of the blade directional control valve 53) of the first center bypass oil passage 31 is connected through the check valve 68 to a neutral connection portion 59 of the second hydraulic pump side center bypass oil passage 32 between the slewing directional control valve 54 and the arm directional control valve 55 (namely, on the upstream side of the arm directional control valve 55). Accordingly, when all of the directional control valves are in their neutral positions, joined oil from the first hydraulic pump P1 and the second hydraulic pump P2 actually flows a portion of the second center bypass oil passage 32 passing the arm directional control valve 55 and the PTO directional control valve 56.

A bleed oil passage 35 is extended from a portion of the first center bypass oil passage 31 on the downstream side of the blade directional control valve 53 and connected through an orifice 75 to a portion of the second hydraulic pump side center bypass oil passage 32 between the arm directional control valve 55 and the PTO directional control valve 56. Accordingly, oil delivered from the first hydraulic pump P1 to be introduced to the neutral connection portion 59 is restricted.

The parallel oil passage 33 comprises the branch oil passages 33*a* and 33*b*, and a confluent oil passage 33*c*. A check valve 40 is disposed between the branch oil passage 33*a* branching from the delivery oil passage of the first hydraulic pump P1 and the confluent oil passage 33*c*. A check valve 41 is disposed between the branch oil passage 33*b* branching from the delivery oil passage of the second hydraulic pump P2 and the confluent oil passage 33*c*. Namely, the confluent oil passage 33*c* is interposed between the check valves 40 and 41 for preventing back flow between the first hydraulic pump P1 and the second hydraulic pump P2. The directional control valves are in parallel supplied with hydraulic oil to their hydraulic actuators from the parallel oil passage 33, i.e., either one of the branch oil passages 33*a* and 33*b* or the confluent oil passage 33*c*.

Description will now be given on constructions of the directional control valves. Each of the directional control valves 50R, 50L, 51, 52, 53, 54, 55, 56, 57 and 58 is three switching position type valve with six ports. The directional control valves can be switched by operating the levers and the pedals on the slewing body 8. Instead of this manual operation, pilot type control valves may be used as the directional control valves. The actuators having the pilot type control valves can be controlled automatically.

When each of the directional control valves is in its neutral position of the three positions, an inhalation port and a delivery port of the valve connected to the first center bypass oil passage 31 or the second hydraulic pump side center bypass oil passage 32 are connected with each other, thereby opening the portion of the center bypass oil passages 31 or 32 in each of the directional control valves for free passage.

With regard to the four remaining ports of each of the directional control valves, one port is connected to the parallel oil passage 33, i.e., either one of the branch oil passages 33*a* and 33*b* or the confluent oil passage 33*c* so as to serve as an inhalation port of hydraulic oil for the actuator as mentioned above. Another port is connected to the tank oil passage 34 so as to serve as a drain port of hydraulic oil for the actuator.

The two remaining ports are connected to the corresponding hydraulic actuator. With regard to each of the hydraulic actuators, the hydraulic cylinder is a double-acting type cylinder and the hydraulic motor is a reciprocal motor. The actuators are driven in two opposite directions. Each of these two ports of the directional control valve serve as either the inhalation port or the discharge port due to which of the two actuating positions other than the neutral position the directional control valve is set to. By supplying hydraulic oil from the directional control valve to the actuator, the actuator drives in one of the two opposite directions.

Description will now be given on a hydraulic circuit between the directional control valve and the hydraulic actuator according to FIGS. 5 to 7.

Figure 5:
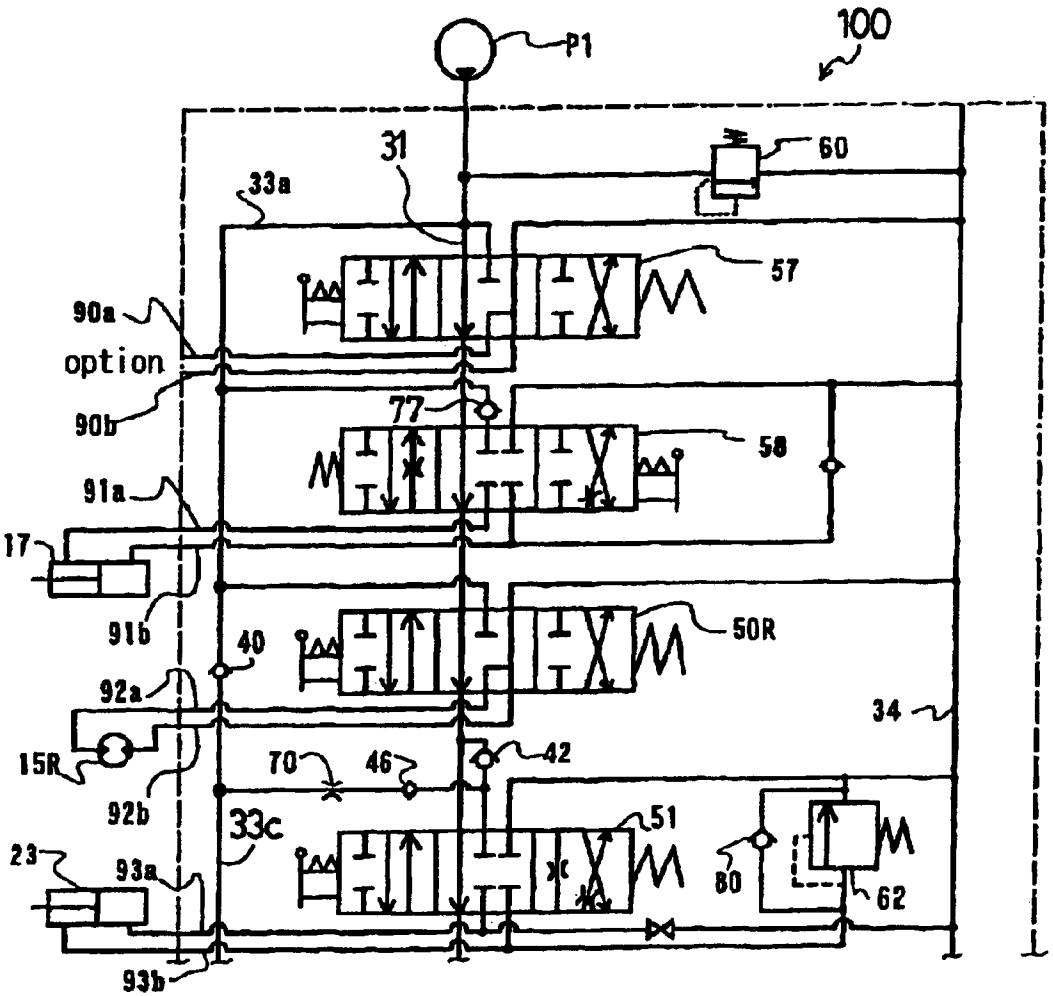
FIG. 5 is an enlarged circuit diagram of a first pump side portion hydraulic portion of the hydraulic circuit 101.

As shown in FIG. 5, the optional directional control valve 57 can feed pressure oil through oil passages 90*a* and 90*b* to an optionally attached hydraulic apparatus, for example, a hydraulic cylinder for adjusting the width between the crawlers.

The swing directional control valve 58 is connected to the swing cylinder 17 through oil passages 91*a* and 91*b*. The right traveling directional control valve 50R is connected to the right traveling motor 15R through oil passages 92*a* and 92*b*.

The boom directional control valve 51 is connected to the boom cylinder 23 through oil passages 93*a* and 93*b*. The oil passage 93*b* is connected to a hydraulic oil drain passage from the drain port of the boom directional control valve 51 to the tank oil passage 34 (henceforth, oil passages which connect the directional control valves with the tank oil passage 34 are called 'hydraulic oil drain passages') through parallel valves of an overload relief valve 62 and a check valve 80. Accordingly, when the boom directional control valve 51 is overloaded, hydraulic oil can be relieved to the tank oil passage 34 through the overload relief valve 62.

Figure 6:
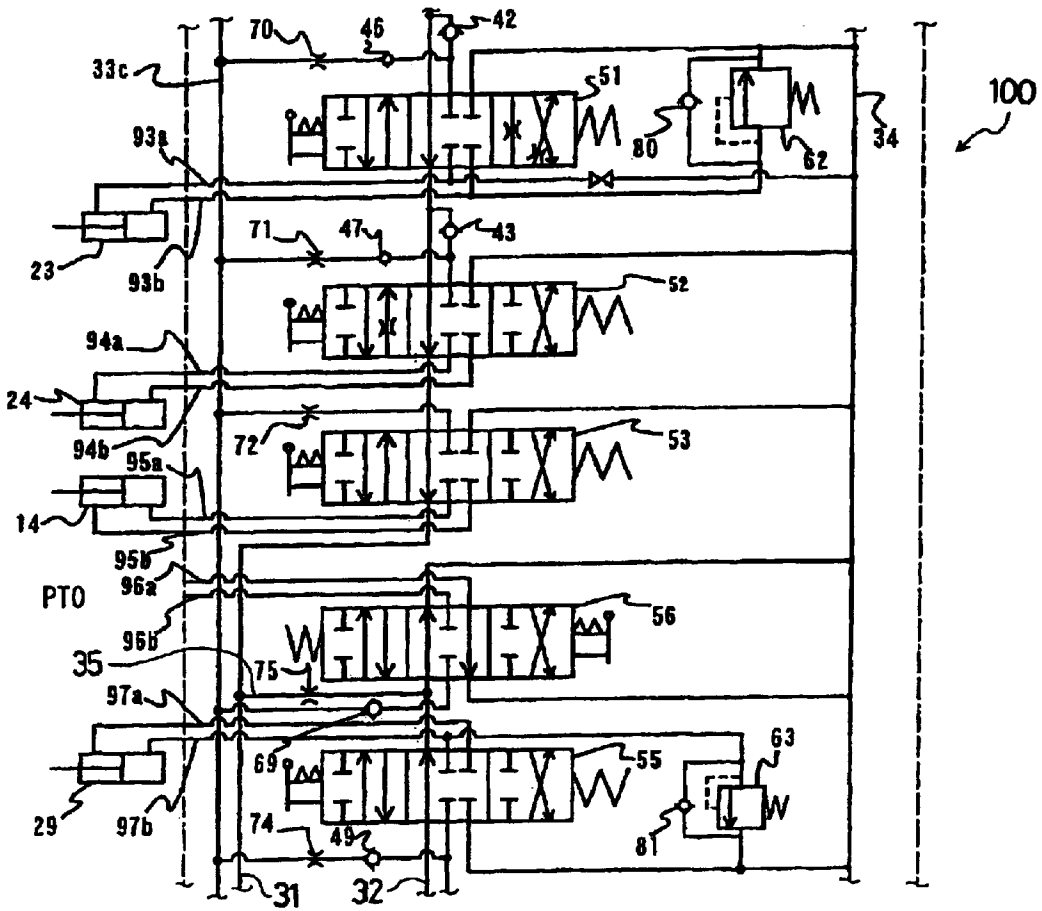
FIG. 6 is an enlarged circuit diagram of a middle portion of the hydraulic circuit 101.

As shown in FIG. 6, the bucket directional control valve 52 is connected to the bucket cylinder 24 through oil passages 94*a* and 94*b*. The blade directional control valve 52 is connected to the blade cylinder 14 through oil passages 95*a* and 95*b*.

As shown in FIG. 7, the left traveling directional control valve 50L is connected to the left traveling motor 15L through oil passages 99*a* and 99*b*.

The slewing directional control valve 54 is connected to the slewing hydraulic motor 13 through oil passages 98*a* and 98*b* (sic). The oil passage 98*a* is connected to a hydraulic oil drain passage of the slewing directional control valve 54 through parallel valves of an overload relief valve 64 and a check valve 82. The oil passage 98*b* is connected to the hydraulic oil drain passage thereof through parallel valves of an overload relief valve 65 and a check valve 83. Accordingly, when right or left slewing of the slewing body 8 causes the slewing directional control valve 54 to be overloaded, hydraulic oil can be relieved to the tank oil passage 34.

The arm directional control valve 55 is connected to the arm cylinder 29 through oil passages 97*a* and 97*b*. The oil passage 97*b* is connected to a hydraulic oil discharge passage of the arm directional control valve 55 through a parallel overload relief valve 63 and a check valve 81. Accordingly, when the arm directional control valve 55 is overloaded, hydraulic oil can be relieved through the overload relief valve 63.

As shown in FIG. 6, end portions of PTO oil passages 96*a* and 96*b* are usually closed, but the end portions can be connected to hydraulic oil pipes of a hydraulic actuator for a work machine by PTO drive (mainly a breaker).

Description will now be given on the hydraulic oil supply passages for the actuators from the parallel oil passage 33 to the directional control valves according to FIGS. 4 to 7.

As shown in FIGS. 4 and 5, hydraulic oil supply passages are extended in parallel from the branch oil passage 33*a* branching from the delivery oil passage of the first hydraulic pump P1 (on the upstream of the check valve 40) and connected to the swing (sic) directional control valve 58 and the right traveling motor directional control valve 50R. A check valve 77 for preventing hydraulic oil from back flow to the branch oil passage 33*a* is interposed in the hydraulic oil supply passage from the swing directional control valve 58. As mentioned above, the hydraulic oil supply passage for the option directional control valve 57 branches from the delivery oil passage of the first hydraulic pump P1 on the furthest upstream end portion of the branch oil passage 33*a*.

As mentioned above, as shown in FIGS. 4 to 7, the hydraulic oil supply passage connected to the left traveling motor directional control valve 50L is extended from the furthest upstream end portion of the branch oil passage 33*b* of the delivery oil passage of the second hydraulic pump P2 (on the upstream of the check valve 41).

As shown in FIGS. 4 to 7, all the other hydraulic oil supply passages connected to the directional control valves 51, 52, 53, 54, 55 and 56 are extended in parallel from the confluent oil passage 33*c*, where oil delivered from the first hydraulic pump P1 and the second hydraulic pump P2 are joined to each other.

As shown in FIGS. 5 to 7, an orifice 70 and a check valve 46 are provided in the hydraulic oil supply passage for the boom directional control valve 51 in tandem. An orifice 71 and a check valve 47 are provided in the hydraulic oil supply passage for the bucket directional control valve 52 in tandem. An orifice 72 is provided in the hydraulic oil supply passage for the blade directional control valve 53. An orifice 73 and a check valve 48 are provided in the hydraulic oil supply passage for the slewing directional control valve 54 in tandem. An orifice 74 and a check valve 49 are provided in the hydraulic oil supply passage for the arm directional control valve 55 in tandem. A check valve 69 is provided in the hydraulic oil supply passage for the PTO directional control valve 56. These check valves prevent hydraulic oil from back flow to the confluent oil passage 33*c*.

A portion of the hydraulic oil supply passage from the confluent oil passage 33*c* to the boom directional control valve 51 on the downstream of the check valve 46 is connected through a check valve 42 to the first center bypass oil passage 31 on the upstream of the boom directional control valve 51 (between the valve 51 and the right traveling motor directional control valve 50R). Similarly, a portion of the hydraulic oil supply passage for the bucket directional control valve 52 on the downstream of the check valve 47 is connected through a check valve 43 to the first center bypass oil passage 31. A portion of the hydraulic oil supply passage for the slewing directional control valve 54 on the downstream of the check valve 48 is connected through a check valve 44 to the second hydraulic pump side center bypass oil passage 32. A portion of the hydraulic oil supply passage for the arm directional control valve 55 on the downstream of the check valve 49 is connected through a check valve 45 to the second hydraulic pump side center bypass oil passage 32. Especially, the check valve 45 is connected to the neutral connection portion 59 of the second hydraulic pump side center bypass oil passage 32 joined to the furthest downstream end portion of the first center bypass oil passage 31.

These check valves 42, 43, 44 and 45 permit only the flow from the center bypass oil passages 31 and 32 to the respective hydraulic oil supply passages, thereby ensuring hydraulic oil from the center bypass oil passages 31 and 32 to be supplied to the hydraulic oil supply passages.

Description will be given on the action of the hydraulic circuit 100 constructed as mentioned above.

The swing directional control valve 58 is supplied with hydraulic oil from the portion of the branch oil passage 33*a* from the first hydraulic pump P1 on the upstream of the hydraulic oil supply passage for the right traveling motor directional control valve 50R. Although hydraulic oil is supplied in this way, the swing cylinder 17 is generally not subject to so large load during its operation as to cause any trouble in supplying hydraulic oil to the right traveling motor directional control valve 50R and supplying hydraulic oil from the confluent oil passage 33*c* to the directional control valves. The same is said about the option equipment hydraulic actuator.

The motor directional control valves 50R and 50L are supplied with hydraulic oil from the respective branch oil passages 33*a* and 33*b* on the upstream of the confluent oil passage 33*c*. In case that each of the motor directional control valves 50R and 50L is positioned in one of its two actuating positions (hereafter, with regard to the description of the directional control valves, 'a valve is positioned in its actuating position' means that the valve is positioned in one of its two actuating positions in this way) so as to drive both the drive sprockets 16, both the traveling directional control valves 50L and 50R shut the respective center bypass oil passages 31 and 32 so as not to supply hydraulic oil from the center bypass oil passages 31 and 32 to the directional control valves 51, 52, 53, 54 and 55 on portions of the center bypass oil passages 31 and 32 of the respective valves 50L and 50R. Accordingly, the directional control valves 51, 52, 53, 54 and 55 are enabled to be supplied with hydraulic oil from only the confluent oil passage 33*c* through the orifices 70, 71, 72, 73 and 74.

Consequently, even when any of the hydraulic actuators supplied with hydraulic oil from the directional control valves 51, 52, 53, 54 and 55 is driven for carrying out drive of any of the work parts of the boom 6, the arm 5, the blade 10 and the bucket 4, or slewing motion of the slewing body 8 simultaneously with traveling of the excavating-and-slewing working vehicle, the motor directional control valves 50R and 50L are supplied with hydraulic oil from the hydraulic pump P1 and P2 at the places on the upstream of the hydraulic oil supply passages for the directional control valves 51 to 55. Furthermore, the amount of oil supplied to each of the hydraulic actuators for driving the work parts and the slewing body 8 is restricted by the corresponding orifice. Accordingly, the amount of hydraulic oil from the hydraulic pump P1 and P2 to the traveling hydraulic motors 15R and 15L is secured so as to ensure translatory movability of the vehicle. That is, when any work part, for example the boom 6, is driven simultaneously with traveling of the vehicle, priority is given to traveling over driving the work part, thereby ensuring translatory movability of the vehicle.

When the option equipment actuator and the swing cylinder 17 and the right traveling hydraulic motor 15R are in neutral state, namely when the directional control valves 58, 57 and 50R are in their neutral positions, the boom directional control valve 51 and the bucket directional control valve 52 are supplied with hydraulic oil for the actuators from the first center bypass oil passage 31 through the respective check valves 42 and 43. When the left traveling directional control valve 50L is in its neutral position so as to set the left traveling hydraulic motor 15L in neutral, the slewing directional control valve 54 and the arm directional control valve 55 are supplied with hydraulic oil for the actuators from the second center bypass oil passage 32 through the respective check valves 44 and 45. Accordingly, when the vehicle is not driven to travel and one of the directional control valves 54 and 55 is set to its actuating position to drive the corresponding actuator alone, hydraulic oil is supplied to the directional control valve from the center bypass oil passage 31 or 32 without going through the orifice, thereby reducing pressure loss of hydraulic pressure and operating the actuator efficiently.

Namely, when any of the boom 6, the arm 5, the bucket 4, and the slewing body 8 is operated alone, as shown in FIG. 3(*a*) (sic), each of the boom cylinder 23 and the bucket cylinder 24 is supplied with hydraulic oil from the first hydraulic pump P1, and each of the slewing motor 13 and the arm cylinder 29 from the second hydraulic pump P2.

In addition, with regard to the hydraulic circuit 100, each of the directional control valves 51, 52, 54 and 55 is also supplied with hydraulic oil for the corresponding actuator from the confluent oil passage 33*c* through the corresponding orifice. Accordingly, for example, when the boom 6 is driven alone, the directional control valve is supplied with direct oil delivered from the first hydraulic pump P1 through the first center bypass oil passage 31, and also with supplemental oil delivered from the second hydraulic pump P2 introduced to the confluent oil passage 33*c* through the orifice 70, whereby driving force applied to the actuator becomes larger than the driving force applied by only the first hydraulic pump P1. In this way, each of the boom cylinder 23, the bucket cylinder 24, the slewing motor 13 and the arm cylinder 29 is operated alone at increased speed so as to improve its working efficiency because it is supplied with oil delivered from the proper hydraulic pump and additionally with hydraulic oil from the other hydraulic pump.

The arm directional control valve 55 is enabled to be supplied with hydraulic oil from the neutral connection portion 59 which is the confluence portion of the first center bypass oil passage 31 and the second center bypass oil passage 32 through the check valve 45 constructed between the arm directional control valve 55 and the slewing directional control valve 54. Accordingly, when only the arm 5 is driven, the arm cylinder 29 is supplied with hydraulic oil from the neutral connection portion 59 which is the confluence portion of pressure oil from the pumps P1 and P2 without going through an orifice, and hydraulic oil from the confluent oil passage 33*c* through the orifice 74, thereby ensuring such a larger driving force as to drive the arm 5 swiftly.

However, as mentioned above, the bleed oil passage 35 from the first center bypass oil passage 31 is connected through the orifice 75 to the portion of the second center bypass oil passage 32 on the downstream of the arm directional control valve 55. With regard to the first center bypass oil passage 31, the bleed oil passage 35 is on the upstream side of the neutral connection portion 59. Therefore, the amount of pressure oil from the first center bypass oil passage 31 to the neutral connection portion 59 is restricted by flowing pressure oil from the first center bypass oil passage 31 to the second center bypass oil passage 32 through the orifice 75. Accordingly, the confluent amount of pressure oil from the center bypass oil passages 31 and 32 supplied to the inhalation port of the arm directional control valve 55 is restricted so as to adjust the operating speed of the arm cylinder 29.

Each of the directional control valves, when being at its actuating position, shuts the corresponding center bypass oil passage 31 or 32 so that other downstream directional control valve (or valves) connected thereto in tandem on the corresponding center bypass oil passage 31 or 32 is not supplied with (or not passed by) hydraulic oil in the corresponding center bypass oil passage 31 or 32 but supplied with only hydraulic oil from the parallel oil passage 33. This construction secures operation balance between two or more actuators supplied with hydraulic oil from the same hydraulic pump (namely, the actuators disposed in the same independent circuit) when they are operated simultaneously.

This will be more detailed. The first center bypass oil passage 31 is connected to the hydraulic oil inhalation port of the boom directional control valve 51 on the upstream of the hydraulic oil inhalation port of the bucket directional control valve 52. Accordingly, when the boom cylinder 23 and the bucket cylinder 24 are driven simultaneously, hydraulic oil from the first center bypass oil passage 31 is directly supplied to the boom directional control valve 51 set in its actuating position without going through an orifice, and hydraulic oil from the confluent oil passage 33*c* is supplied to the boom directional control valve 51 through the orifice 70. Therefore, while the boom cylinder 23 obtains a large driving force, the driving force of bucket cylinder 24 is restricted because hydraulic oil from the first pump side bypass oil passage 31 obstructed by the boom directional control valve 51 is not supplied to the bucket directional control valve 52 in its actuating position but hydraulic oil from the confluent oil passage 33*c* is supplied to the bucket directional control valve 52 through the orifice 71.

For simultaneously operating the boom 6 and the bucket 4, hydraulic pressure required to drive the boom cylinder 23 is larger than hydraulic pressure required to drive the bucket cylinder 24 because the boom 6 is heavier than the bucket 4 so that load applied to the boom cylinder 23 is larger than load applied to the bucket cylinder 24. Accordingly, hydraulic oil is supplied to the directional control valves 51 and 52 in the above-mentioned way, so that balance of hydraulic pressure and balance of operating speed between the directional control valves are maintained and an operator can work smoothly without feel of incongruity.

The hydraulic oil inhalation port of the slewing directional control valve 54 is connected to the second center bypass oil passage 32 on the upstream of the hydraulic oil inhalation port of the arm directional control valve 55. Accordingly, when the slewing motor 13 and the arm cylinder 29 are driven simultaneously, hydraulic oil from the second hydraulic pump side center bypass oil passage 32 is supplied to the slewing directional control valve 54 in its actuating position directly without going through an orifice, and hydraulic oil from the confluent oil passage 33*c* is supplied to the slewing directional control valve 54 through the orifice 73. Therefore, while the slewing motor 13 obtains a large driving force, hydraulic oil from the second center bypass oil passage 32 obstructed by the slewing motor 13 is not supplied to the arm directional control valve 55 in its actuating position but hydraulic oil from the first center bypass oil passage 31 is introduced to the neutral connection portion 59 so as to be supplied to the arm cylinder 29. The oil from the first center bypass oil passage 31 is reduced as much as a part of oil flowing therefrom to the bleed oil passage 35, however, the deficiency of the oil is compensated with supply of hydraulic oil from the confluent oil passage 33*c* through the orifice 74. Accordingly, driving force for the arm cylinder 29 is secured while the amount of hydraulic oil supplied to the arm cylinder 29 is less than that supplied to the slewing motor 13.

For simultaneously driving the stewing body 8 and the arm 5, the stewing motor 13 is supplied with larger hydraulic pressure than the arm cylinder 29 as mentioned above while the stewing body 8 causes a larger load than the arm 5 because the stewing body 8 is heavier and receives a larger inertial force than the arm 5. Accordingly, hydraulic pressure and operating speed are balanced well between the actuators 13 and 29 and an operator can work smoothly without feel of incongruity.

As shown in FIG. 3, for example, when the boom 6 and the stewing body 8 are driven simultaneously, hydraulic oil for the boom cylinder 23 is supplied from the first center bypass oil passage 31 to the boom directional control valve 51 without going through an orifice (but through the check valve 42), and hydraulic oil for the stewing motor 13 is supplied from the second center bypass oil passage 32 to the stewing directional control valve 54 without going through the orifices (through the check valve 44). Accordingly, the boom cylinder 23 is driven by the first hydraulic pump P1, and the stewing motor 13 is driven by the second hydraulic pump P2, whereby sufficient actuating forces are given to the respective hydraulic actuators. The same is also said in other simultaneous drive of the bucket 4 and the stewing body 8, of the bucket 4 and the arm 5, and of the boom 6 and the arm 5.

However, if the hydraulic circuit 100 is used for simultaneously driving the arm 5 and the stewing body 8, as the above mentioned, the first and second hydraulic pumps P1 and P2 substantially independently supply to the arm cylinder 24 and the stewing motor 13 respectively while the bleed oil passage 35 restricts hydraulic pressure for operating the arm cylinder 24. In case that, during slewing drive of the stewing body 8, restriction of the actuating force of the arm cylinder 24 is unnecessary but the arm 5 is desired to increase its driving speed, a later-discussed hydraulic circuit 100*a* or 100*b* is available. Each of the hydraulic circuits 100*a* and 100*b*, when the stewing directional control valve 54 is set in its actuating position, supplies pressure oil from the first center bypass oil passage 31 without bleeding to the arm directional control valve 55 so as to improve operativity of the arm 5 during stewing drive of the stewing body.

Hydraulic oil is not supplied from the second center bypass oil passage 32 to the hydraulic oil inhalation port of the PTO directional control valve 56. The hydraulic oil supply passage from the confluent oil passage 33*c* is connected to the hydraulic oil inhalation port thereof without going through an orifice (but through the check valve 69). Accordingly, in case that the other actuators are in neutral state, high operation hydraulic pressure can be secured for PTO. A breaker mainly serves as the PTO actuator. The breaker is usually used when the vehicle is stationary. Therefore, almost all amount of pressure oil delivered from the hydraulic pump P1 and P2 is used as hydraulic oil for operating the breaker and hydraulic oil and supplied to the PTO directional control valve 56 without going through an orifice, whereby hydraulic pressure is reduced so as to improve efficiency of work with the breaker.

Hydraulic oil for the blade cylinder 14 is not supplied from the first center bypass oil passage 31 (sic) but from the confluent oil passage 33*c* through a hydraulic oil passage with the orifice 72 to the inhalation port of the blade directional control valve 53. The branching order of this hydraulic oil passage with the orifice 72 on the confluent oil passage 33*c* between check valves 40 and 41 is substantially the same whether it may be counted from the check valve 40 or 41 (exactly, the order is the third counted from the check valve 40 and the fourth counted from the check valve 41). Namely, this hydraulic oil passage branches substantially at the middle point between the oil passages to the respective directional control valves 50L and 50R.

Consequently, when soil-removing work is carried out by the blade 10 simultaneously with traveling of the vehicle, the pressure loss of the hydraulic oil sent from the confluent oil passage 33*c* at the branch point to the traveling directional control valve 50R on the delivery passage from the first hydraulic pump P1 is substantially equal to the pressure loss at the branch point to the traveling directional control valve 50L on the delivery passage from the second hydraulic pump P2 so that hydraulic pressure becomes substantially equal between the directional control valves 50L and 50R, thereby improving translatory movability of the vehicle.

Figure 8:
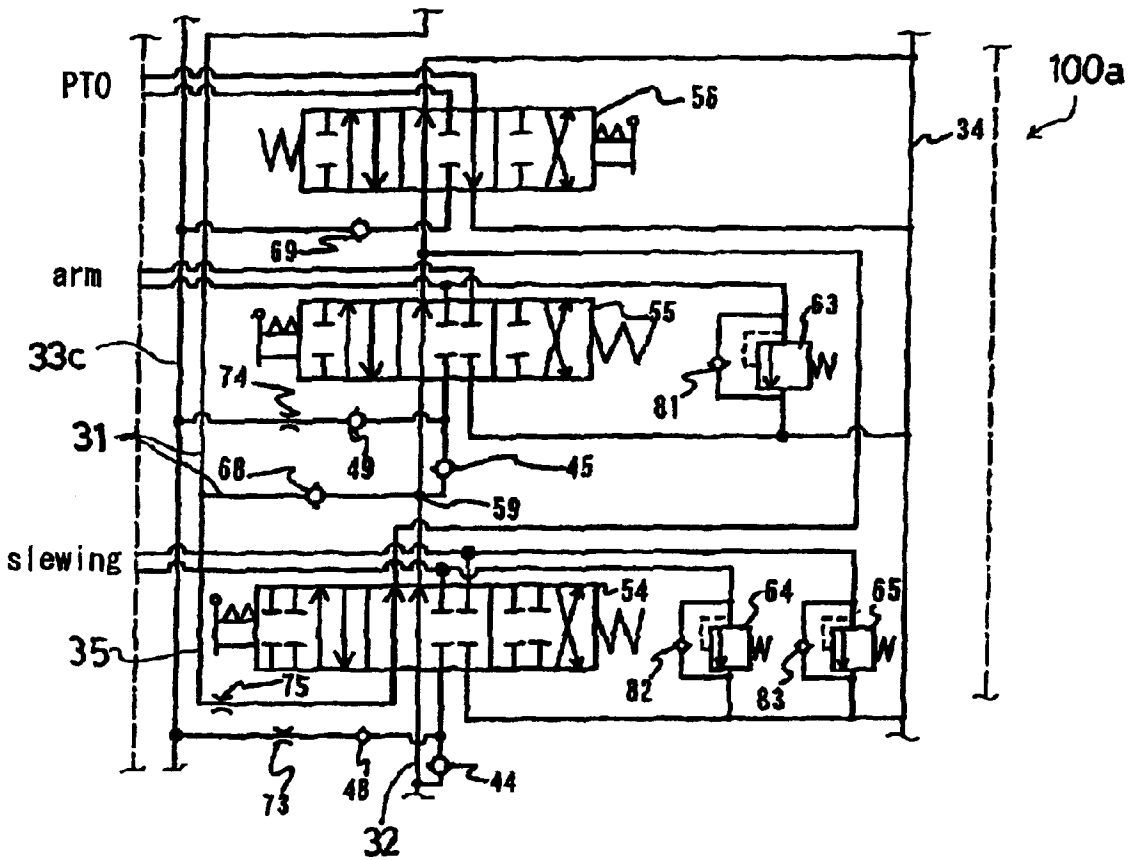
FIG. 8 is a circuit diagram of a hydraulic circuit 100*a* as a modification of the hydraulic circuit 100, wherein a slewing directional control valve 54 incorporates a bleed circuit for adjusting speed of the arm.
Figure 9:
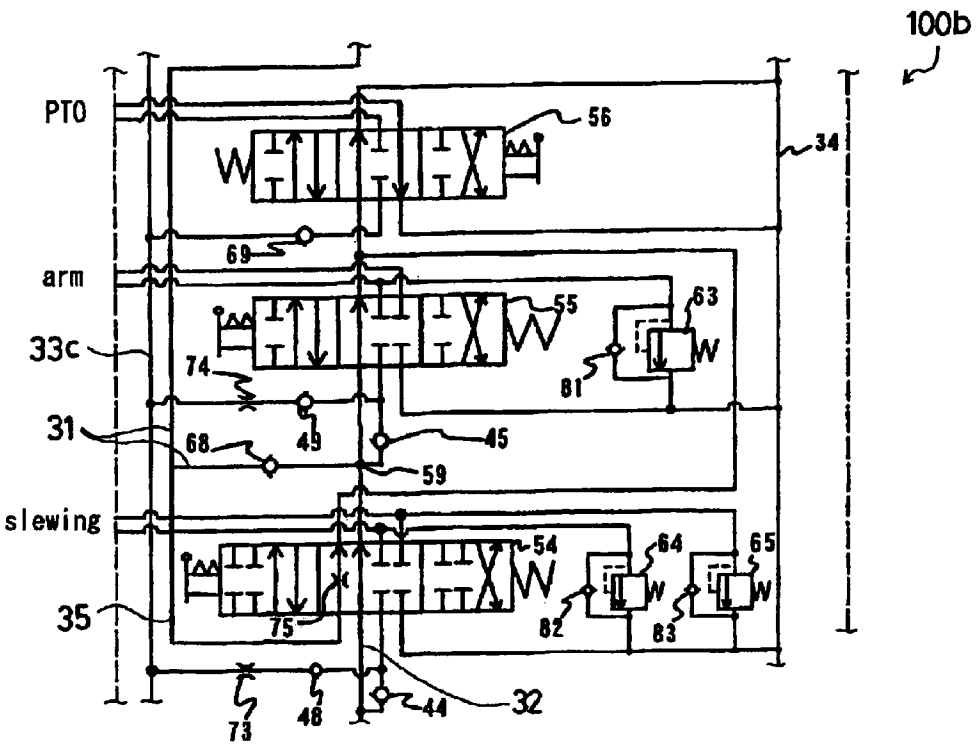
FIG. 9 is a circuit diagram of a hydraulic circuit 100*b* as a further modification of the same.

Next, description will be given on the hydraulic circuit 100*a* shown in FIG. 8, which serves as a modification of the hydraulic circuit 100 improved in its bleed circuit.

According to this embodiment, with respect to the second center bypass oil passage 32, the slewing directional control valve 54 on the upstream side of the arm directional control valve 55 is provided with a bleed circuit so that the slewing directional control valve 54, when being set in its actuating position, is closed to the bleed circuit.

In this regard, a control valve having eight ports and switched among three positions serves as the slewing directional control valve 54, and a bleed passage is formed therein so as to close when the valve 54 is in its actuating position. The bleed oil passage 35 through the orifice 75 is connected to the primary side of the bleed passage of the slewing directional control valve 54. The secondary side of the bleed passage of the slewing directional control valve 54 is connected to a portion of the second center bypass oil passage 32 (the confluent passage of the first center bypass oil passage 31 and the second center bypass oil passage 32) between the arm directional control valve 55 and the PTO directional control valve 56 (on the downstream of the arm directional control valve 55). Namely, the bleed oil passage 35 branching from the first center bypass oil passage 31 connected to the arm directional control valve 55 (the neutral connection portion 59) is passed through the slewing directional control valve 54, and constructed to open and close interlocking with the slewing directional control valve 54.

According to this construction, when the slewing motor 13 and the arm cylinder 29 are operated simultaneously, the slewing directional control valve 54 in its actuating position closes the bleed oil passage 35 so as to shut the second center bypass oil passage 32 off from the arm directional control valve 55. Accordingly, while hydraulic oil from the second center bypass oil passage 32 is supplied to the hydraulic oil inhalation port of the slewing directional control valve 54 through the check valve 44 (furthermore, hydraulic oil from the confluent oil passage 33*c* is also supplied thereto through the orifice 75 and the check valve 49), hydraulic oil from the first center bypass oil passage 31 is supplied to the hydraulic oil inhalation port of the arm directional control valve 55 through the check valve 45 without being bled to the bleed oil passage 35 (furthermore, hydraulic oil from the confluent oil passage 33*c* is also supplied thereto through the orifice 74 and the check valve 49). Accordingly, both the slewing motor 13 and the arm cylinder 29 can obtain high hydraulic pressure.

When the slewing motor 13 is in neutral state and the arm cylinder 29 is operated, the bleed oil passage 35 is opened interlocking with the slewing directional control valve 54 in its neutral position. Accordingly, oil in the first center bypass oil passage 31 flows to the neutral connection portion 59 through a check valve 68, and joins to oil from the second center bypass oil passage 32 through the slewing directional control valve 54. The oil is supplied to the hydraulic oil inhalation port of the arm directional control valve 55, and flows to the bleed oil passage 35 with the orifice 75 on the upstream of the neutral connection portion 59. The bleed oil flows through the slewing directional control valve 54 to a portion of the second center bypass oil passage 32 on the downstream of the arm directional control valve 55. Accordingly, oil of the first center bypass oil passage 31 used as hydraulic oil of the arm cylinder 29 is restricted, thereby controlling the actuating speed of the arm cylinder 29.

Generally, a spool is used for constructing the bleed circuit in the slewing directional control valve 54. With regard to the hydraulic circuit 100*b* shown in FIG. 9, the orifice 75 is not interposed in the portion of the bleed oil passage 35 on the primary side of the slewing directional control valve 54 as shown in the hydraulic circuit 100*a* of FIG. 8, but is incorporated in a spool assembled in the slewing directional control valve 54. According to this construction, flux of oil in the bleed circuit can be changed only by exchanging the spool, thereby facilitating easy change of actuating speed of the arm 5.

Next, description will be given on a hydraulic circuit 101 of the excavating-and-slewing working vehicle shown in FIG. 10. Parts in this embodiment have the same construction and function of the parts in the hydraulic circuit shown in FIGS. 4 to 7, unless they are specified.

With regard to this hydraulic circuit, the first center bypass oil passage 31 comprises the swing directional control valve 58, the boom directional control valve 51, the bucket directional control valve 52, one of the right and left traveling directional control valves (in this embodiment, the right traveling directional control valve 50R for the right traveling motor 15R) and the blade directional control valve 53 arranged in tandem from the upstream side. The second center bypass oil passage 32 comprises the option directional control valve 57, the slewing directional control valve 54, the other left or right traveling directional control valve (in this embodiment, the left traveling directional control valve 50L for the left traveling motor 15L), the arm directional control valve 55 and the PTO directional control valve 56 arranged in tandem from the upstream side.

The furthest downstream end portion of the first center bypass oil passage 31 joins to the neutral connection portion 59 of the second center bypass oil passage 32 between the left traveling directional control valve 50L and the arm directional control valve 55. Confluent oil from the center bypass oil passages 31 and 32 can be supplied as hydraulic oil for the arm cylinder 29. After joining to the first center bypass oil passage 31, the second center bypass oil passage 32 passes through the PTO directional control valve 56 and is connected to the tank oil passage 34.

The swing directional control valve 58 can be supplied with hydraulic oil for the swing cylinder 17 from the branch point of the branch oil passage 33*a* on the first center bypass oil passage 31. The boom directional control valve 51 and the bucket directional control valve 52 can be supplied with hydraulic oil for the boom cylinder 23 and bucket cylinder 24, respectively, from the first center bypass oil passage 31. The option directional control valve 57 can be supplied with hydraulic oil for the option equipment actuator from the delivery oil passage of the second hydraulic pump P2 from the branch point of the branch oil passage 33*b* on the second center bypass oil passage 32. The arm directional control valve 55 and the PTO directional control valve 56 can be supplied with hydraulic oil for the arm cylinder 29 and the PTO equipment actuator, respectively, from the second center bypass oil passage 32 after joining to the first center bypass oil passage 31.

Similarly with the hydraulic circuit 100, the parallel oil passage 33 is provided for parallel supplying hydraulic oil to the actuators through directional control valves. However, the hydraulic oil supply passages to the boom directional control valve 51, the bucket directional control valve 52 and the right traveling directional control valve 50R branch from the branch oil passage 33*a* on the upstream of the check valve 40. The hydraulic oil supply passage to the slewing directional control valve 54 branches from the branch oil passage 33*b* on the upstream of the check valve 41. The hydraulic oil supply passages to the left traveling directional control valve 50L and the blade directional control valve 53 branch from the confluent oil passage 33*c*.

Accordingly, with regard to the hydraulic circuit 101, the right traveling hydraulic motor 15R is supplied with hydraulic oil from the downstream side of the hydraulic oil passages for the boom cylinder 23 and the bucket cylinder 24, and the left traveling hydraulic motor 15L from the downstream side of the hydraulic oil passage for the slewing motor 13, whereby priority is given to drive of the work machine 2 over traveling of the vehicle. However, similarly with the hydraulic circuit 100, the right and left traveling directional control valve 50L and 50R may be alternatively disposed on the upstream of the boom directional control valve 51, the bucket directional control valve 52 and the slewing directional control valve 54 so as to ensure translatory movability of the vehicle under work.

The second center bypass oil passage 32 after joining to the first center bypass oil passage 31 passes a bleed switching valve 85 located between the arm directional control valve 55 and the PTO directional control valve 56. The bleed oil passage 35 connects the primary side of the bleed switching valve 85 with the portion of the first center bypass oil passage 31 between the blade directional control valve 53 and the neutral connection portion 59. No orifice is not interposed in the bleed oil passage 35 shown in FIG. 10, however, an orifice of an arbitrary open degree may be provided for regulating the amount of pressure oil in the portion of the first center bypass oil passage 31 to the neutral connection portion 59. This orifice will be discussed later according to an embodiment shown in FIGS. 26 and 27.

The bleed switching valve 85 is provided with three ports and switched among three positions. Two of the ports are a P port and a T port for the second center bypass oil passage 32, and the two ports are always connected to each other for free passage. The other port is a bleed oil inhalation port connected to the bleed oil passage 35.

When the bleed switching valve 85 is set to its neutral position, the bleed oil passage 35 is connected to a portion of the second center bypass oil passage 32 in the bleed switching valve 85 so as to make a short path of pressure oil from the first center bypass oil passage 31 to the PTO directional control valve 56 bypassing the neutral connection portion 59. When the bleed switching valve 85 is set to one of the two positions other than its neutral position, the bleed oil inhalation port is separated from the portion of the second center bypass oil passage 32 in the bleed switching valve 85.

The bleed switching valve 85 is operatively connected to an operation lever 87 for switching the slewing directional control valve 54 so as to be switched in relation to switching of the slewing directional control valve 54 among the three positions. Accordingly, when the slewing directional control valve 54 is set to its neutral position, the bleed switching valve 85 is set to its neutral position so as to connect the bleed oil passage 31 to the second center bypass oil passage 32. When the slewing directional control valve 54 is set to its actuating position, the bleed switching valve 85 separates the bleed oil passage 31 from the second center bypass oil passage 32.

The first center bypass oil passage 31 is provided in a portion thereof between the branch point to the bleed oil passage 35 and the neutral connection portion 59 with a check valve 68 for preventing the flow from the neutral connection portion 59 to the bleed oil passage 35. Therefore, oil from the second center bypass oil passage 32 flowing to the first center bypass oil passage 31 through the neutral connection portion 59 is prevented from flowing into the bleed oil passage 35.

Incidentally, according to this embodiment, all the directional control valves and the bleed switching valve 85 in the hydraulic circuit 101 are constructed to be manually operated by operation of the levers and pedals provided on the slewing body 8 (although the bleed switching valve 85 is switched in association with operation of the slewing lever 87 for switching the slewing directional control valve 54). However, any of the valves may be arbitrarily replaced with a hydraulic pressure pilot control valve or an electromagnetic solenoid valve. An embodiment employing such hydraulic pressure control valves will be described later according to FIGS. 29 and 30.

With regard to the hydraulic circuit 101 of the above mentioned construction, the parallel oil passage 33 extend the hydraulic supply oil passages to the boom directional control valve 51, the bucket directional control valve 52, the slewing directional control valve 54 and the arm directional control valve 55 from the respective branch oil passages 33*a* and 33*b* thereon. Accordingly, the independency of the hydraulic pumps from each other in supplying hydraulic oil through these directional control valves to the corresponding hydraulic actuators, as shown in FIG. 3(*a*), is secured higher than that of the hydraulic circuit 100.

Furthermore, as shown in FIG. 3(*b*), in the hydraulic circuit 101, oil delivered from the first hydraulic pump P1 is supplied as hydraulic oil to the arm cylinder 29 while it is regulated in quantity by the bleed circuit comprising the bleed switching valve 45 and the check valve 46. Accordingly, when the arm cylinder 29 is driven alone, not only pressure oil from the second hydraulic pump P2 but also pressure oil from the first hydraulic pump P1 regulated by the bleed circuit is supplied to the arm cylinder 29.

Description will be given on the action of the hydraulic circuit 101 according to FIGS. 10 to 15.

Figure 10:
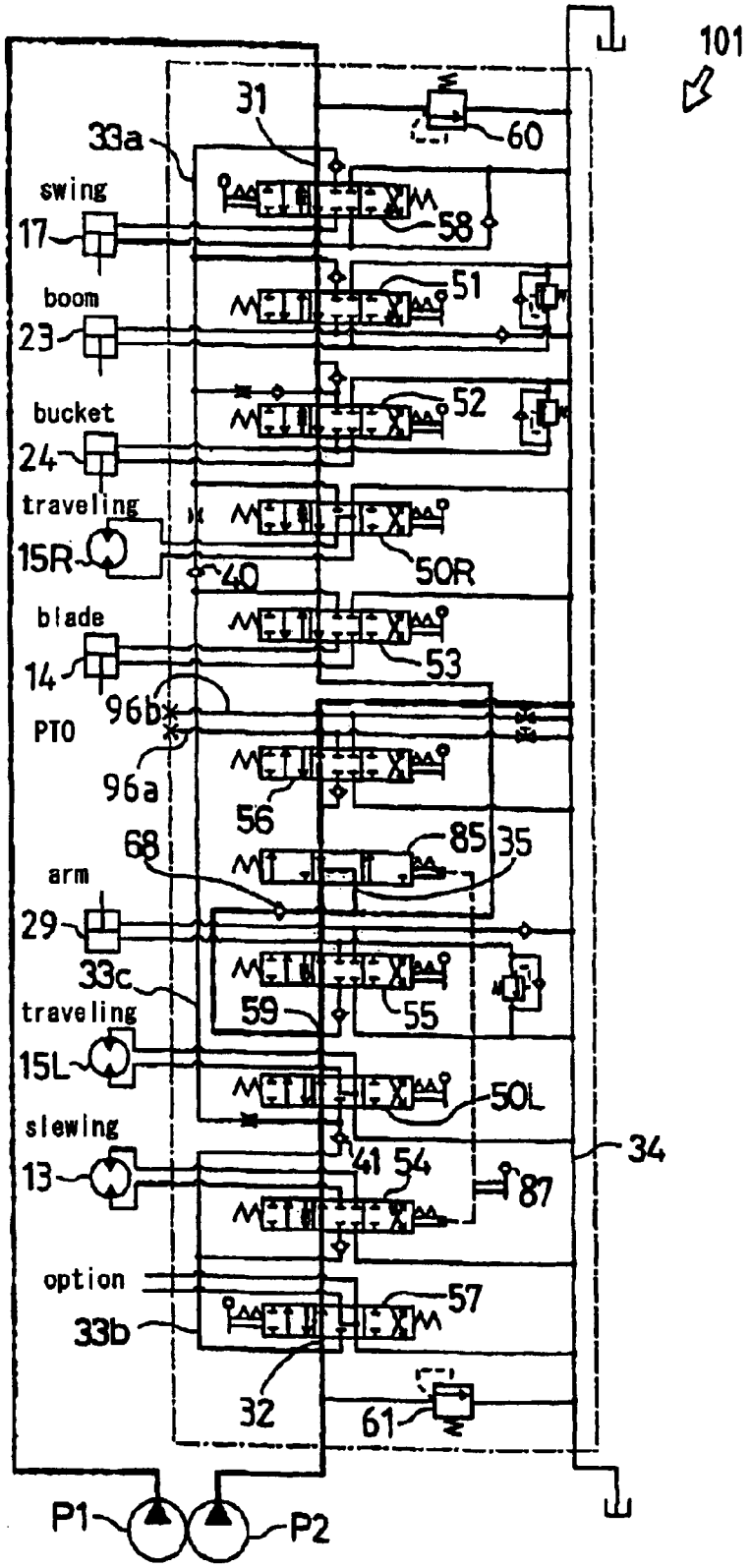
FIG. 10 is a circuit diagram of a hydraulic circuit 101 of an excavating-and-slewing working vehicle according to the present invention, enabled to drive the slewing body and the arm simultaneously, showing a state thereof where all the directional control valves are set to their neutral positions.

FIG. 10 illustrates a state of the hydraulic circuit 101 where all of the directional control valves and the bleed switching valve 85 are set to their neutral positions. The first center bypass oil passage 31 and the second center bypass oil passage 32 are opened over the whole lines. Pressure oil delivered from the pumps P1 and P2 are drained to the oil tank through the center bypass oil passages 31 and 32, drawn in bold lines in FIG. 10, and the tank oil passage 34.

Figure 11:
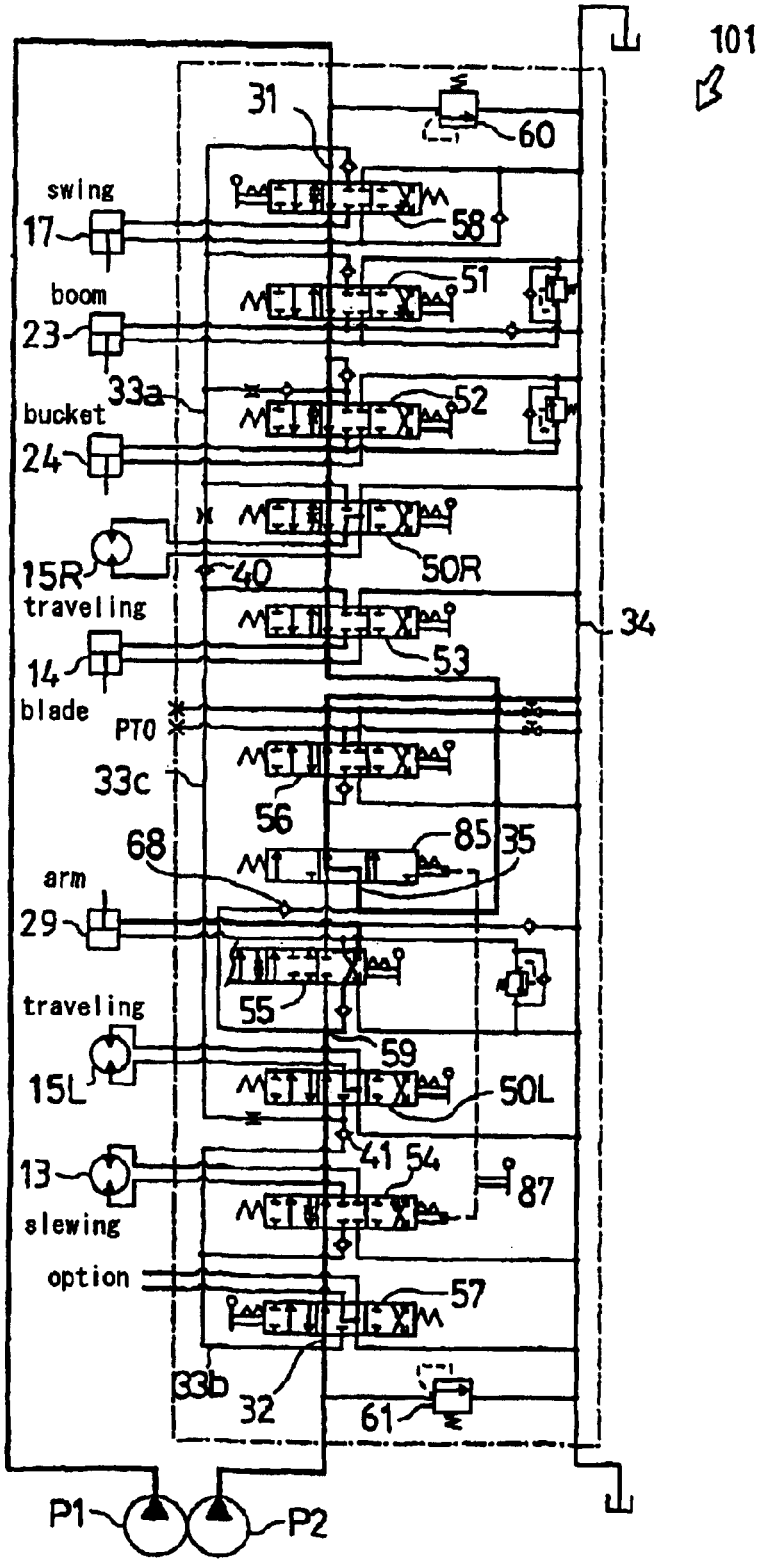
FIG. 11 is a circuit diagram of the hydraulic circuit 101, showing a state thereof where an arm directional control valve 55 is set to its actuating position.

FIG. 11 illustrates a state of the hydraulic circuit 101 where only the arm 5 is driven. The arm directional control valve 55 is set to its actuating position, and pressure oil in the second center bypass oil passage 32 is supplied to the arm cylinder 29 through the arm directional control valve 55. In this state, the bleed switching valve 85 is in its neutral position and is opened to a bleed oil passage 31*a*. Oil from the first center bypass oil passage 31 supplied to the arm directional control valve 55 as hydraulic oil for the arm cylinder 29 is short-circuited to the second center bypass oil passage 32 on the upstream of the PTO directional control valve 56 before the oil reaches the neutral connection portion 59. Accordingly, oil from the first center bypass oil passage 31 is not supplied to the arm directional control valve 55. Only oil from the second center bypass oil passage 32 is supplied to the arm cylinder 29, thereby ensuring that the arm 5 is driven by only the second hydraulic pump P2.

Figure 12:
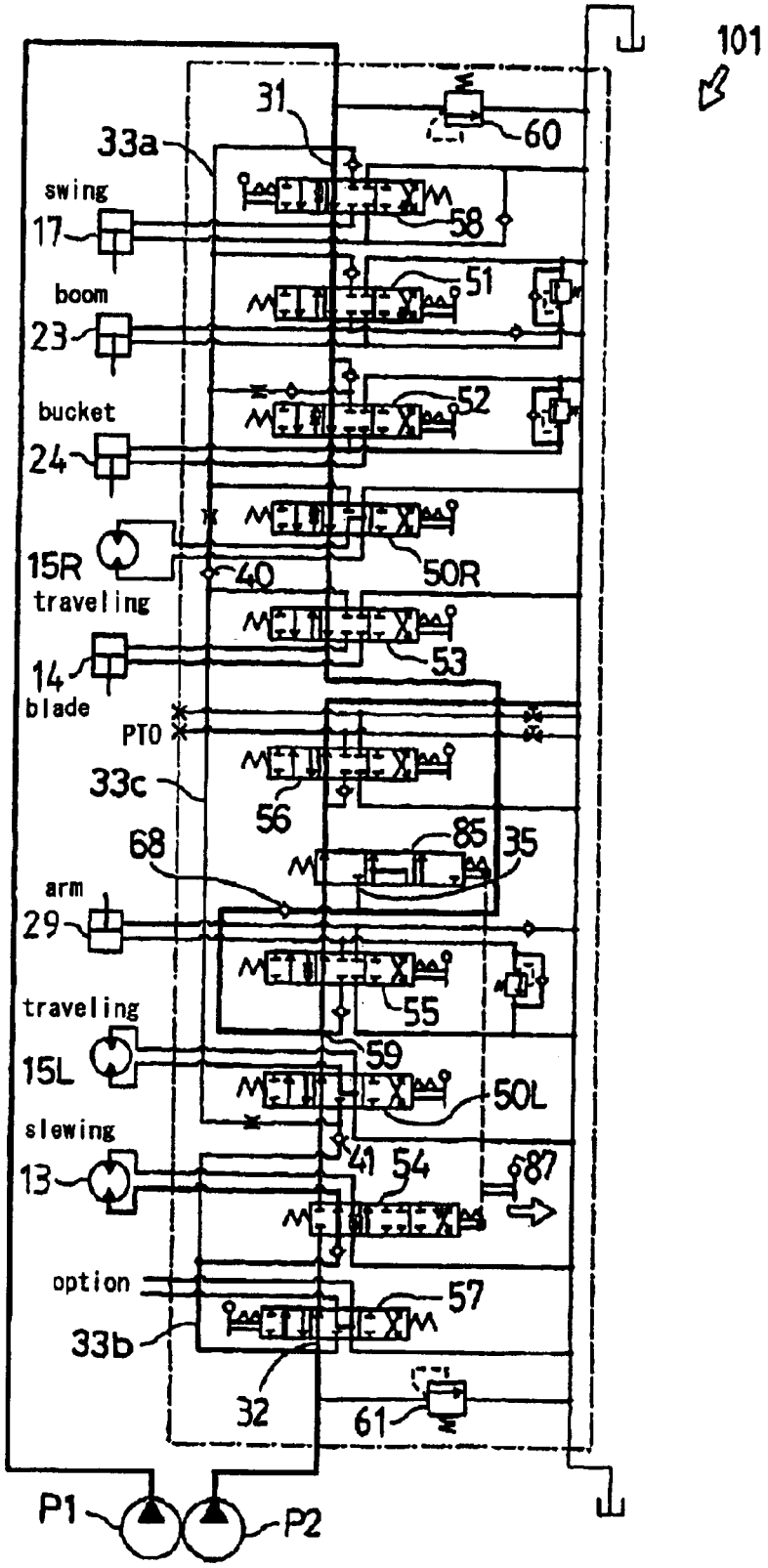
FIG. 12 is a circuit diagram of the hydraulic circuit 101, showing a state thereof where a slewing directional control valve 54 is set to its actuating position.

In case that only slewing drive of the slewing body 8 is carried out, the slewing directional control valve 54 is set to its actuating position, and pressure oil from the pumps P1 and P2 is delivered through the route shown in FIG. 12. According to the interlocking connection of the bleed switching valve 85 with the slewing directional control valve 54, the bleed switching valve 85 is switched to be closed to the bleed oil passage 31*a*. Accordingly, pressure oil from the first hydraulic pump P1 does not flow to the bleed oil passage 31*a* but flows to be joined to the second center bypass oil passage 32 and drained to the oil tank through the arm directional control valve 55 in neutral state. Only pressure oil from the second hydraulic pump P2 (pressure oil from the branch oil passage 33*b*) is supplied to the slewing motor 13 through the slewing directional control valve 54, thereby ensuring that the slewing motor 13 is driven by only the second hydraulic pump P2.

Figure 13:
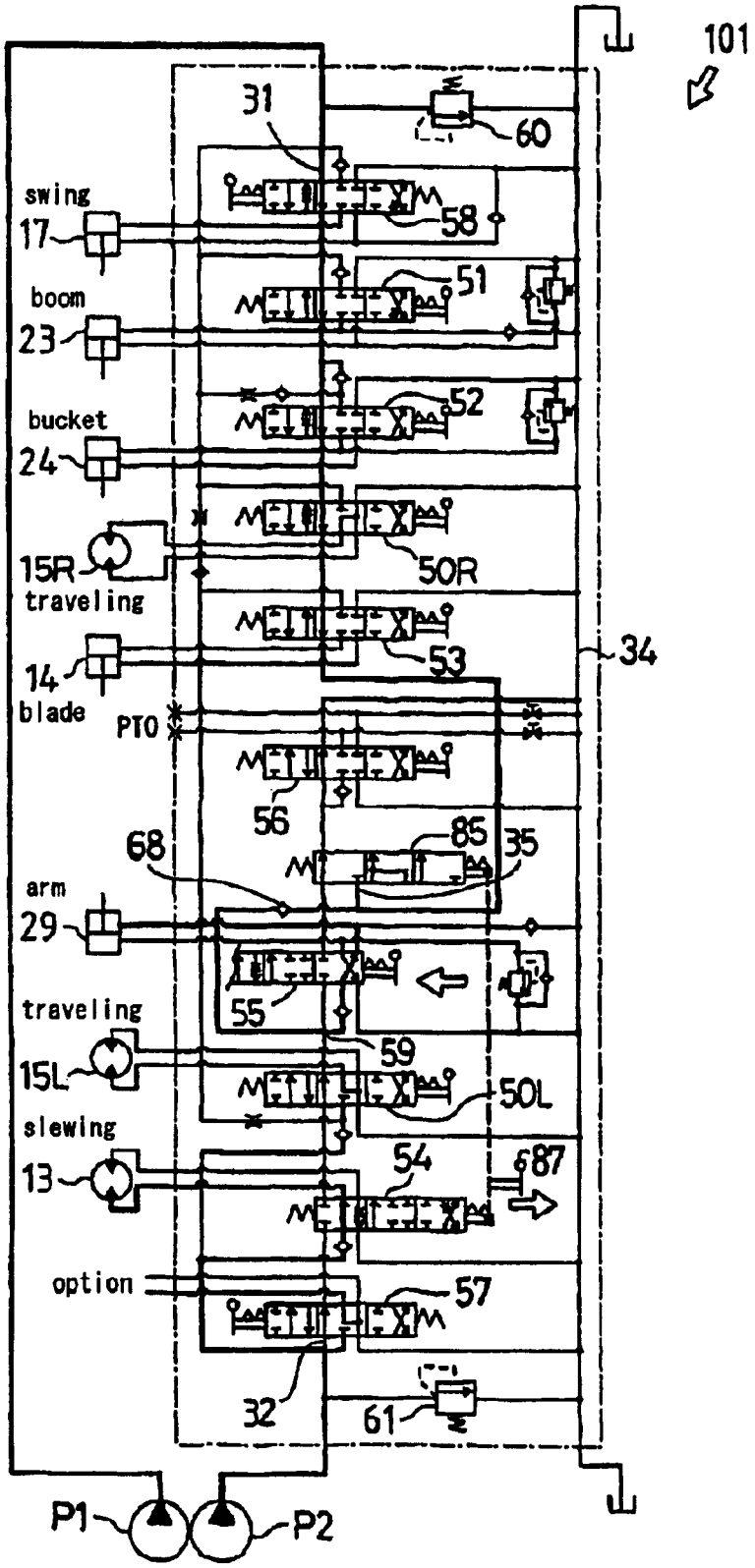
FIG. 13 is a circuit diagram of the hydraulic circuit 101, showing a state thereof where the arm directional control valve 55 and the slewing directional control valve 54 are set to their actuating positions.
Figure 14:
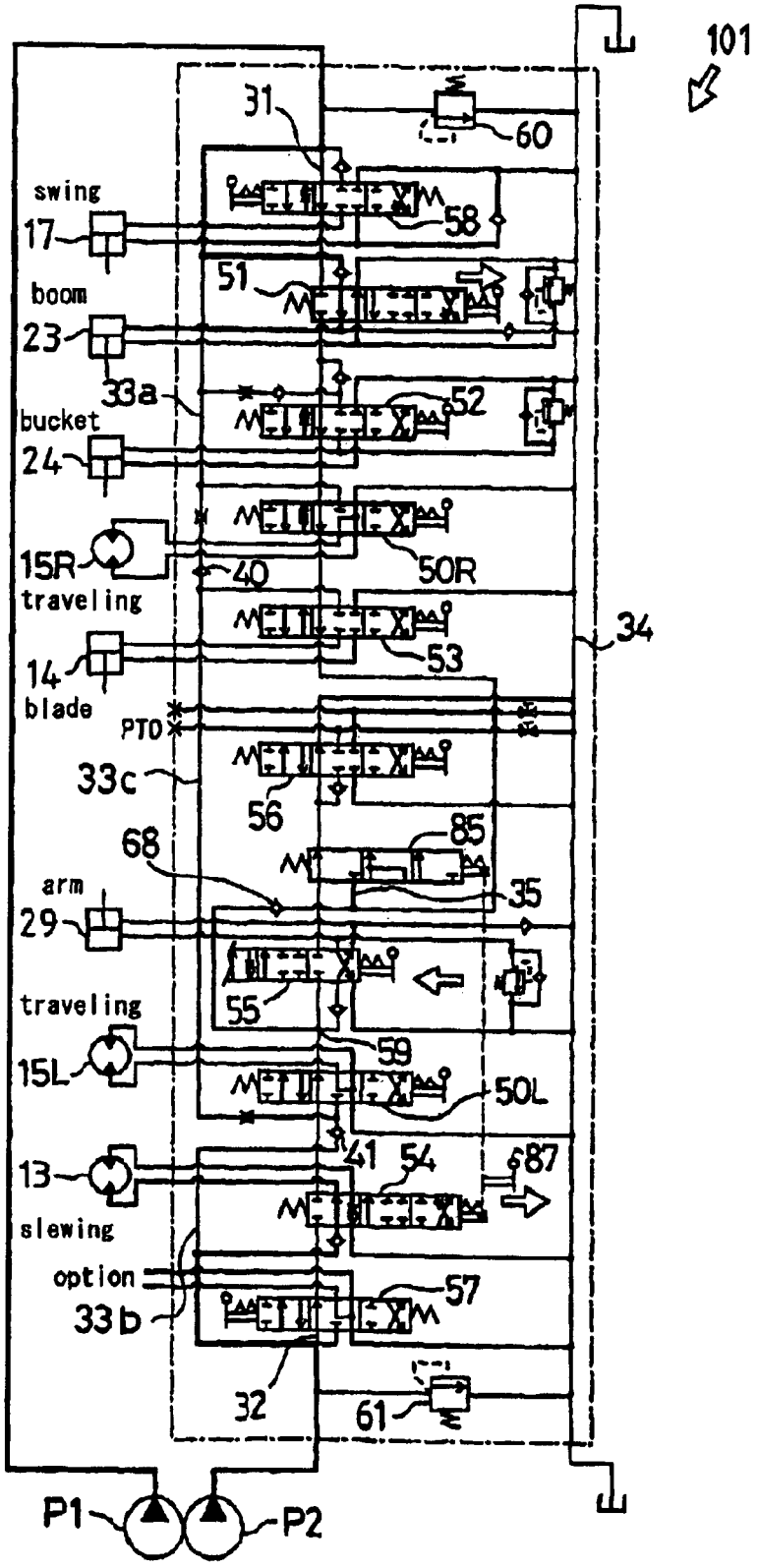
FIG. 14 is a circuit diagram of the hydraulic circuit 101, showing a state thereof where a bucket directional control valve, the arm directional control valve 55 and the slewing directional control valve 54 are set to their actuating positions.

When slewing drive of the slewing body 8 and drive of the arm 5 are carried out simultaneously, the arm directional control valve 55 and the slewing directional control valve 54 are set to their actuating positions, and the bleed switching valve 85 is opened to the bleed oil passage 31*a*, thereby ensuring that pressure oil from the pumps P1 and P2 is delivered through the route shown in FIG. 13. Pressure oil from the second hydraulic pump P2 is supplied to the slewing motor 13 through the branch oil passage 33*b* and the slewing directional control valve 54, thereby ensuring that the slewing body 8 is driven only by the second hydraulic pump P2. Pressure oil from the first hydraulic pump P1 is obstructed to flow into the bleed switching valve 85 and supplied to the arm cylinder 29 through the arm directional control valve 55, thereby ensuring that the arm 5 is driven only by the first hydraulic pump P1. Accordingly, with regard to the hydraulic circuit 101, the slewing body 8 and the arm 5 are driven by different pumps respectively.

Due to the construction of the hydraulic circuit 101 shown in FIG. 10 or another figure, the boom directional control valve 51 is supplied with hydraulic oil for the boom cylinder 23 from the branch oil passage 33*a* supplied with only the oil delivered from the first hydraulic pump P1. The bucket directional control valve 52 is supplied with hydraulic oil for the bucket cylinder 24 from the branch oil passage 33*a* and the first center bypass oil passage 31. The slewing directional control valve 54 is supplied with hydraulic oil for the slewing motor 13 from the branch oil passage 33*b* supplied with only the oil delivered from the second hydraulic pump P2. When the slewing directional control valve 54 is in neutral state (and exactly, the option directional control valve 57 is also in neutral state), the arm directional control valve 55 is supplied with hydraulic oil for the arm cylinder 29 (sic) basically from the second hydraulic pump P2 (and supplied a little pressure oil bled from the first hydraulic pump P1). When the slewing directional control valve 54 is set to its actuating position, the arm directional control valve 55 is supplied with hydraulic oil from the first hydraulic pump P1.

Therefore, the arm cylinder 29 and the slewing motor 13 constitute the independent circuit with the second hydraulic pump P2 as shown in FIG. 3(*a*). The hydraulic circuit 101 of the first embodiment is enabled to supply pressure oil from the first hydraulic pump P1 to the arm cylinder 29 through the check valve 68 when the bleed switching valve 85 is closed to the bleed oil passage 35. Further, it is enabled to use the pumps of different independent circuits as shown in FIG. 3(*b*) when slewing drive of the slewing body 8 and drive of the arm 5 are carried out simultaneously. Accordingly, the arm cylinder 29 and the stewing motor 13 are driven by different pumps so as to ensure their simultaneous activity.

When the arm 5 and the bucket 4 are driven simultaneously, or when drive of the boom 6 and slewing drive of the slewing body 8 are carried out simultaneously, the actuators are driven by the respective independent circuits, that is, each actuator is driven by one of the pumps, thereby ensuring their satisfactory simultaneous activity.

Thus, with regard to the hydraulic circuit 101, the applicability of simultaneous activity among the arm 5, the bucket 4, the boom 6 and the slewing body 8 becomes as shown in FIG. 16.

From view of FIG. 16, compared with a conventional hydraulic circuit of two pump system for an excavating-and-slewing working vehicle, it appears that the simultaneous operativity of the arm 5 and the slewing body 8 is improves due to the effect of the opening and closing bleed switching valve 85. With regard to this simultaneous double-operation of the arm and the slewing body, the hydraulic circuit 101 of two pump system is additionally provided with a few parts, such as the check valve 68 and the bleed switching valve 85, so as to economically obtain the applicability of simultaneous activity equal to a hydraulic circuit of three pump system.

However, as shown in FIG. 16, the hydraulic circuit 101 is not enabled to perform simultaneous triple-drive of the arm 5, the boom 6 and the slewing body 8. The reason will be described according to FIG. 14. In the hydraulic circuit 101, when the boom directional control valve 51, the arm directional control valve 55 and the slewing directional control valve 54 are set to their actuating positions simultaneously, pressure oil from the second hydraulic pump P2 is supplied to the slewing motor 13, and pressure oil from the first hydraulic pump P1 is supplied to the boom cylinder 23. However, a hydraulic oil supply portion for the arm cylinder 29 is located at a portion of the second (sic) center bypass oil passage 32 on the downstream of the supply portion for the slewing motor 13, and also at a portion of the second center bypass oil passage 31 on the downstream of the supply portion for the boom cylinder 23. Therefore, the arm cylinder 29 cannot be supplied with hydraulic oil from any of the pumps. Accordingly, even when three operations of drive the boom 6 and the arm 5, and slewing drive of the slewing body (sic) 8 are going to be carried out, the arm 5 cannot be driven.

Figure 15:
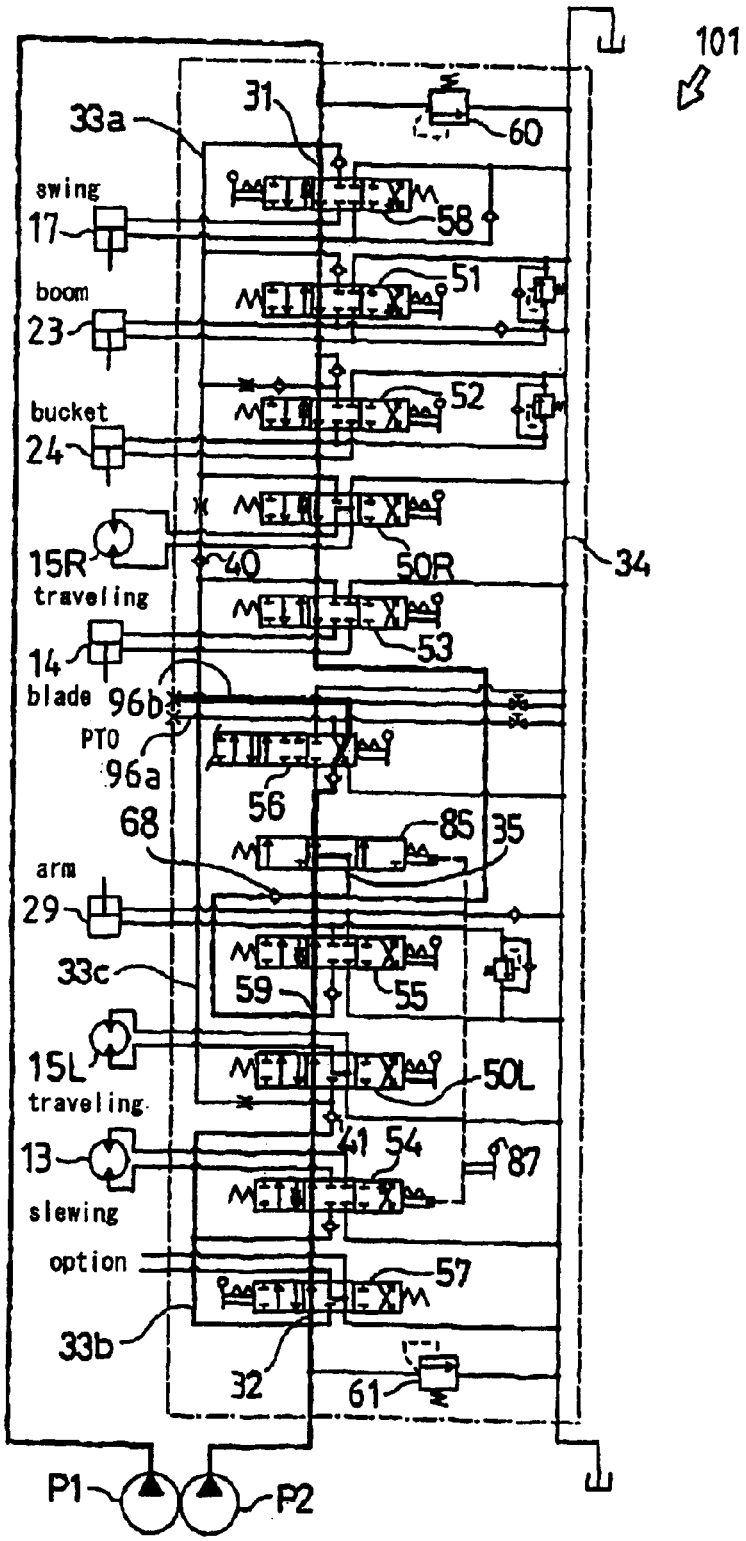
FIG. 15 is a circuit diagram of the hydraulic circuit 101, showing a state thereof where a PTO directional control valve is set to its actuating position.

Incidentally, FIG. 15 illustrates the hydraulic circuit 101 when the PTO equipment is driven alone. Similarly with the above-mentioned embodiment of hydraulic oil 100, the PTO directional control valve 56 is connected to oil passages 96*a* and 96*b* to be connected to ports of the PTO actuator (generally, for a breaker). The PTO directional control valve 56 is provided on the confluent passage of the center bypass oil passages 31 and 32 on the downstream of the bleed switching valve 85.

When all the directional control valves other than the PTO directional control valve 56 are in neutral state, the PTO directional control valve 56 can be supplied with oil delivered from the pumps P1 and P2 for the PTO actuator so as to supply sufficient amount of hydraulic oil to the PTO-driven work machine, thereby improving the activity of the PTO-driven work machine. When any directional control valve in the independent circuit with the first hydraulic pump P1 is set in its actuating position, the PTO directional control valve 56 is supplied with hydraulic oil from the second hydraulic pump P2. When any directional control valve in the independent circuit with the second hydraulic pump P2 is set in its actuating position, the PTO directional control valve 56 is supplied with hydraulic oil from the first hydraulic pump P1.

Figure 17:
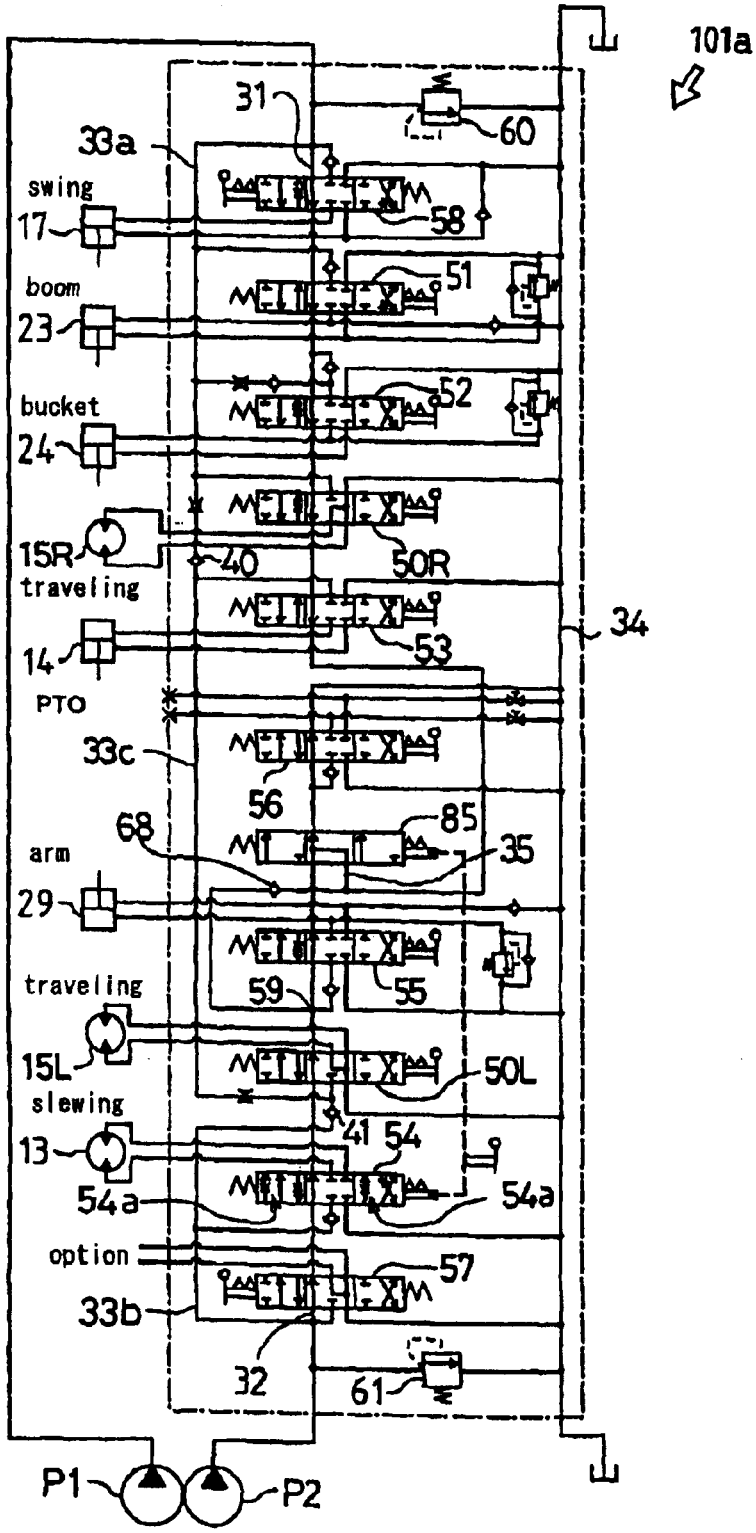
FIG. 17 is a circuit diagram of a hydraulic circuit 101*a* including a slewing directional control valve 54 incorporating a bleed orifice 54*a*, showing a state thereof where all the directional control valves are set to their neutral positions.
Figure 18:
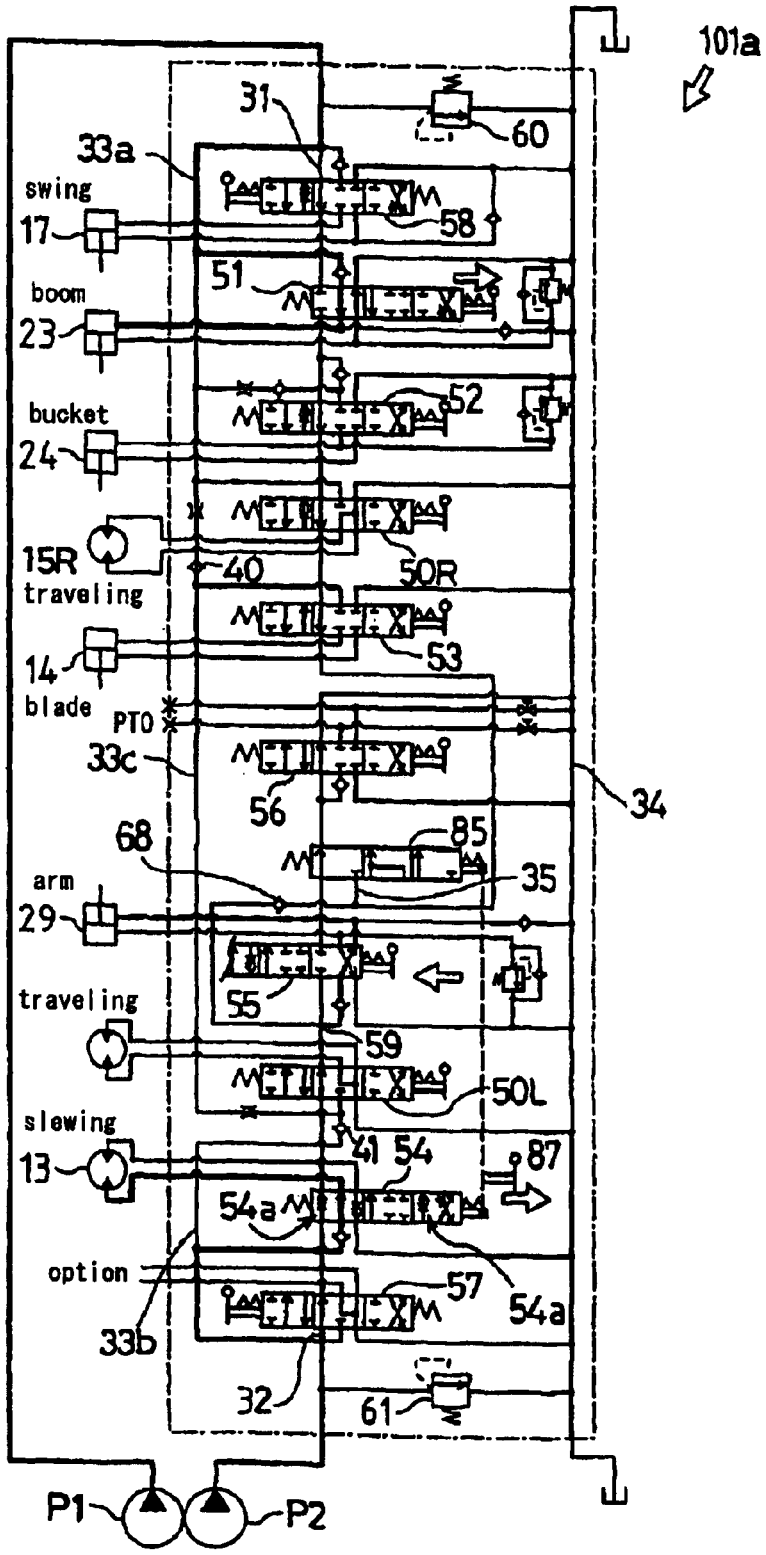
FIG. 18 is a circuit diagram of the hydraulic circuit 101*a*, showing a state thereof where a bucket directional control valve, a boom directional control valve 51, an arm directional control valve 55 and the slewing directional control valve 54 are set to their actuating positions.

Next, description will be given on FIGS. 17 and 18 showing a hydraulic circuit 101*a*, which can drive the three of the boom 6, the arm 5 and the slewing body 8 simultaneously. FIG. 17 shows a state of the hydraulic circuit 101*a* where all the directional control valves are set to their neutral positions. FIG. 18 shows a state of the hydraulic circuit 101*a* where the boom directional control valve 51, the arm directional control valve 55 and the slewing directional control valve 54 are located in their actuating positions. FIG. 19 shows a list about the applicability of simultaneous activity among the arm 5, the bucket 4, the boom 6, and the slewing body 8 with regard to the hydraulic circuit 101*a*.

The hydraulic circuit 101*a* serves as the hydraulic circuit 101 having the slewing directional control valve 54 improved, so that, while pressure oil delivered from the second hydraulic pump P2 is supplied to the slewing motor 13, some of the pressure oil is supplied to the arm cylinder 29. Other parts of the construction are the same as those of the hydraulic circuit 101.

The slewing directional control valve 54 in the hydraulic circuit 101 includes a P port (an upstream port of the second center bypass oil passage 32) and a T port (a downstream port of the second center bypass oil passage 32), which are separated from each other so as not to allow pressure oil delivered from the second hydraulic pump P2 to flow into the oil tank when the valve 54 is set to its actuating position for driving the slewing motor 13.

The stewing directional control valve 54 in the hydraulic circuit 101*a* includes a P port and a T port, which are connected to each other through a bleed orifice 54*a* when the valve 54 is set to each of its actuating positions for driving the stewing motor 13, as shown in FIGS. 17 and 18. Therefore, as shown in FIG. 18, while pressure oil from the second hydraulic pump P2 is supplied to the stewing motor 13, some of the pressure oil is supplied to the arm cylinder 29 as surplus to the flow for driving the stewing body 8.

With regard to the hydraulic circuit 101*a*, the applicability of simultaneous activity among the arm 5, the bucket 4, the boom 6 and the stewing body 8 becomes as shown in FIG. 19. When the three directional control valves are switched to their actuating positions for simultaneously operating the arm cylinder 29, the boom cylinder 23 and the stewing motor 13, the arm 5 can be driven though its drive speed is slow.

Due to this construction, the hydraulic circuit 101*a* of two pump system can perform the simultaneous triple-operation of the arm 5, the boom 6 and the stewing body 8 similarly with a hydraulic circuit of three pump system.

Figure 20:
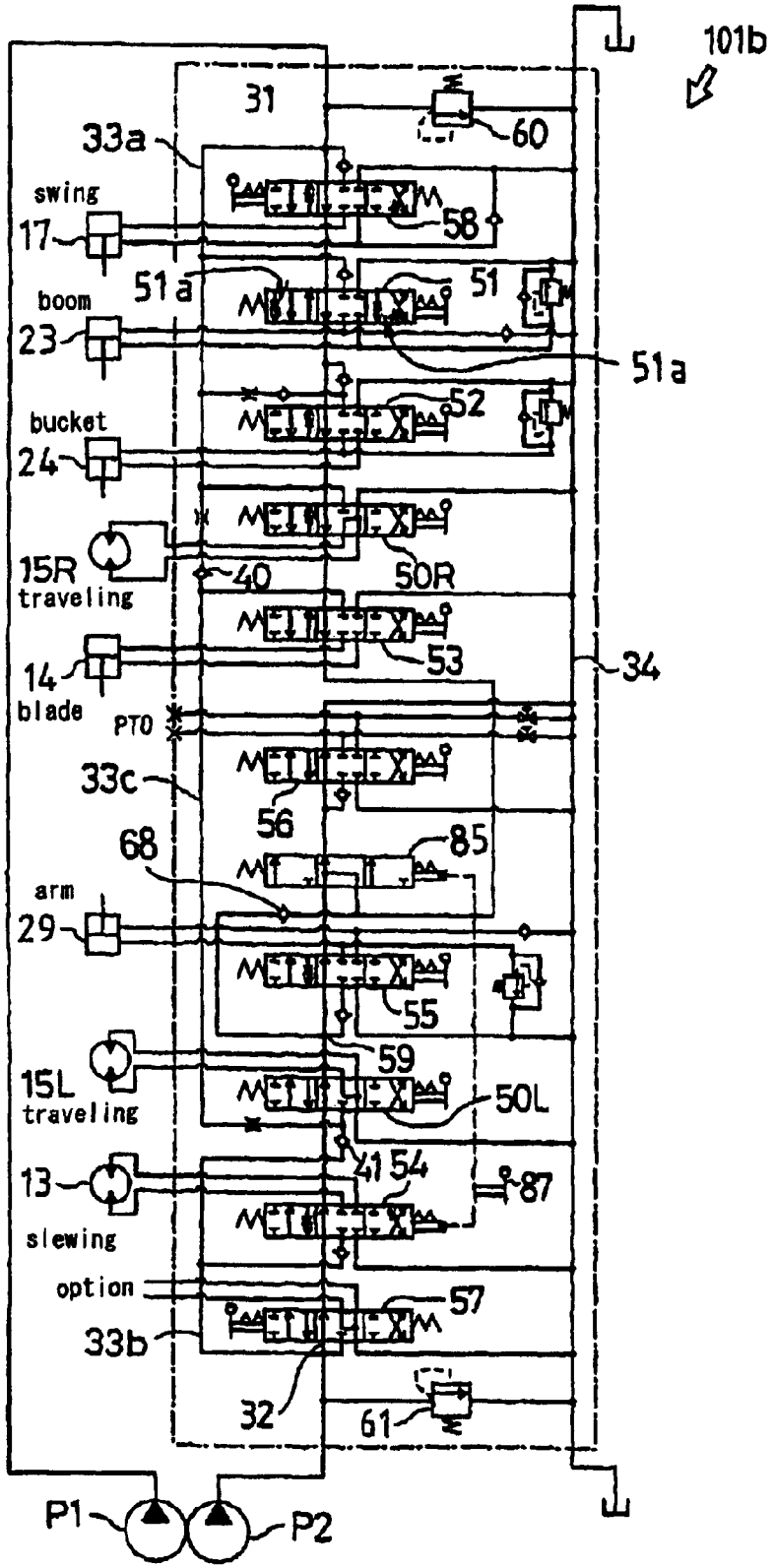
FIG. 20 is a circuit diagram of a hydraulic circuit 101*b* including a boom (sic) directional control valve 51 incorporating a bleed orifice 51*a*, showing a state thereof where all the directional control valves are set to their neutral positions.
Figure 21:
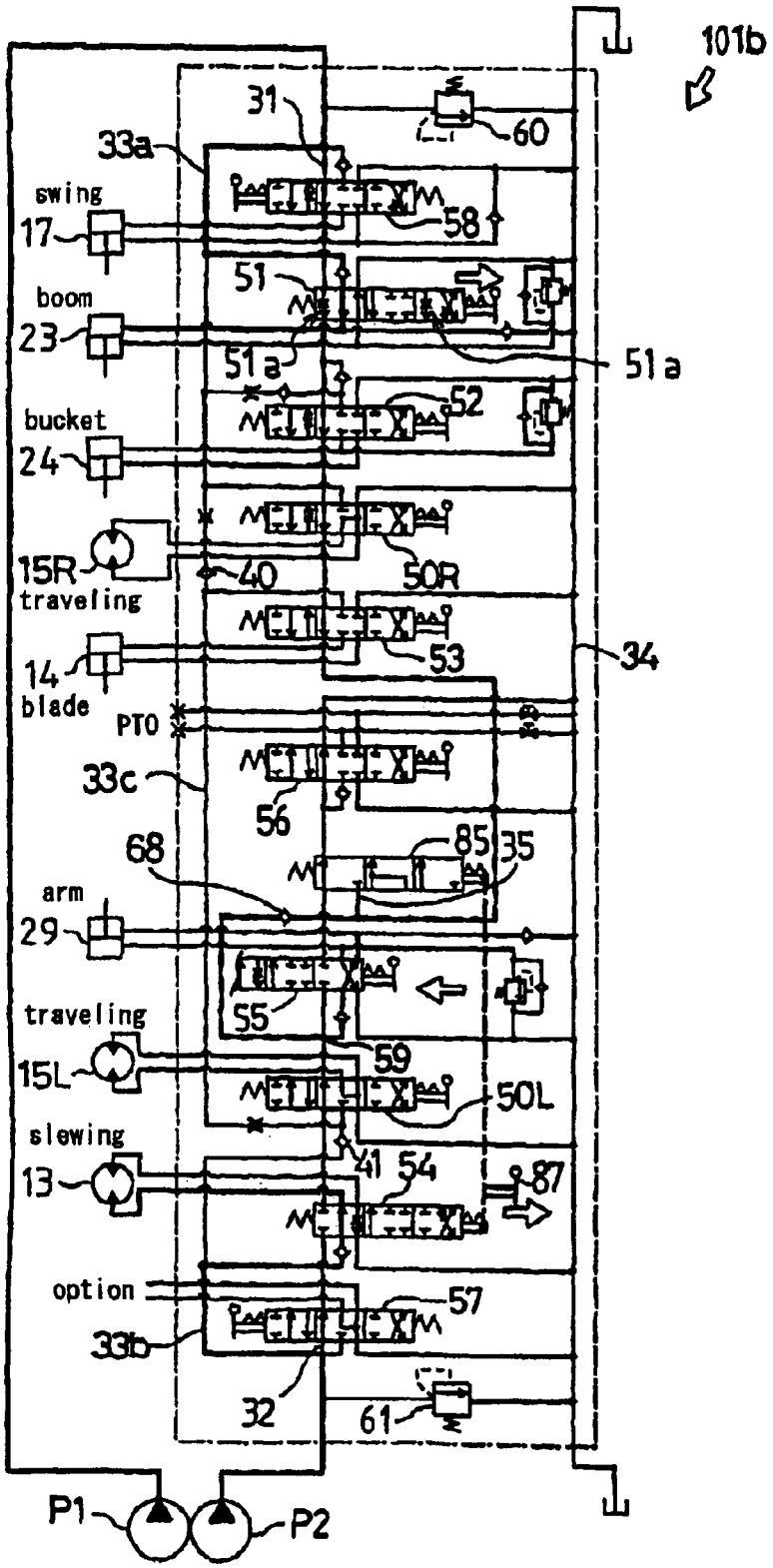
FIG. 21 is a circuit diagram of the hydraulic circuit 101*b*, showing a state thereof where the boom directional control valve 51, an arm directional control valve 55 and a slewing directional control valve 54 are set to their actuating positions.

Description will be given on a hydraulic circuit 101*b* as another embodiment enabled to carry out simultaneous triple-operation of the arm 5, the boom 6 and the stewing body 8 according to FIGS. 20 to 22. FIG. 20 shows a state of the hydraulic circuit 101*b* where all the directional control valves are set to their neutral positions. FIG. 21 shows a state of the hydraulic circuit 101*b* where the boom directional control valve 51, the arm directional control valve 55 and the slewing directional control valve 54 are set to their actuating positions. FIG. 22 shows a list about the applicability of simultaneous activity among the arm 5, the bucket 4, the boom 6, and the stewing body 8.

The hydraulic circuit 101*b* serves as the hydraulic circuit 101 having the boom directional control valve 51 improved so that, while pressure oil delivered from the first hydraulic pump P1 is supplied to the boom cylinder 23, some of the pressure oil is supplied to the arm cylinder 29. Other parts of the construction are the same as those of the hydraulic circuit 101.

The boom directional control valve 51 in the hydraulic circuit 101 includes a P port (an upstream port of the first center bypass oil passage 31) and a T port (a downstream port of the first center bypass oil passage 31), which are separated from each other so as not to allow pressure oil delivered from the first hydraulic pump P1 to flow into the oil tank when the valve 51 is set to its actuating position for driving the boom cylinder 23.

On the other hand, the boom directional control valve 51 in the hydraulic circuit 101*b* includes a P port and a T port, which are connected to each other through a bleed orifice 51*a* when the valve 51 is set to each of its actuating positions for driving the boom cylinder 23, as shown in FIGS. 20 and 21. Therefore, as shown in FIG. 21, while pressure oil from the first hydraulic pump P1 is supplied to the boom cylinder 23, some of the pressure oil is supplied to the arm cylinder 29 as surplus to the flow for driving the boom cylinder 23.

With regard to the hydraulic circuit 101*b*, the applicability of simultaneous activity among the arm 5, the bucket 4, the boom 6 and the slewing body 8 becomes as shown in FIG. 22. When the three directional control valves are switched to their actuating positions for simultaneously operating the arm cylinder 29, the boom cylinder 23 and the slewing motor 13, the arm 5 can be driven though its drive speed is slow.

Due to this construction, the hydraulic circuit 101*b* of two pump system can perform the simultaneous triple-operation of the arm 5, the boom 6 and the slewing body (sic) 8 similarly with a hydraulic circuit of three pump system.

Figure 23:
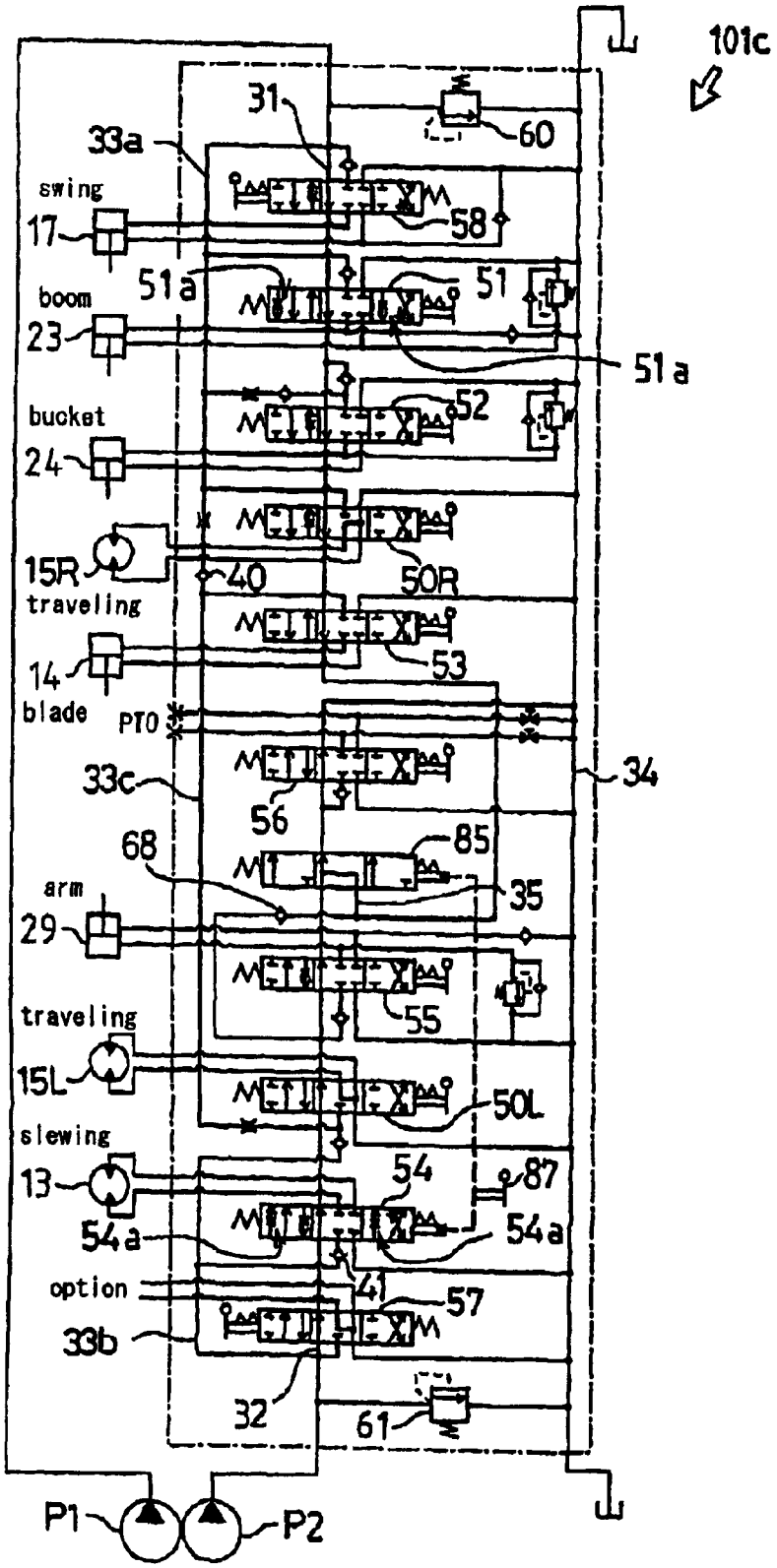
FIG. 23 is a circuit diagram of a hydraulic circuit 101*c*, wherein both the boom (sic) directional control valve 51 and the slewing directional control valve 54 incorporate respective bleed orifices, showing a state thereof where all the directional control valves are set to their neutral positions.
Figure 24:
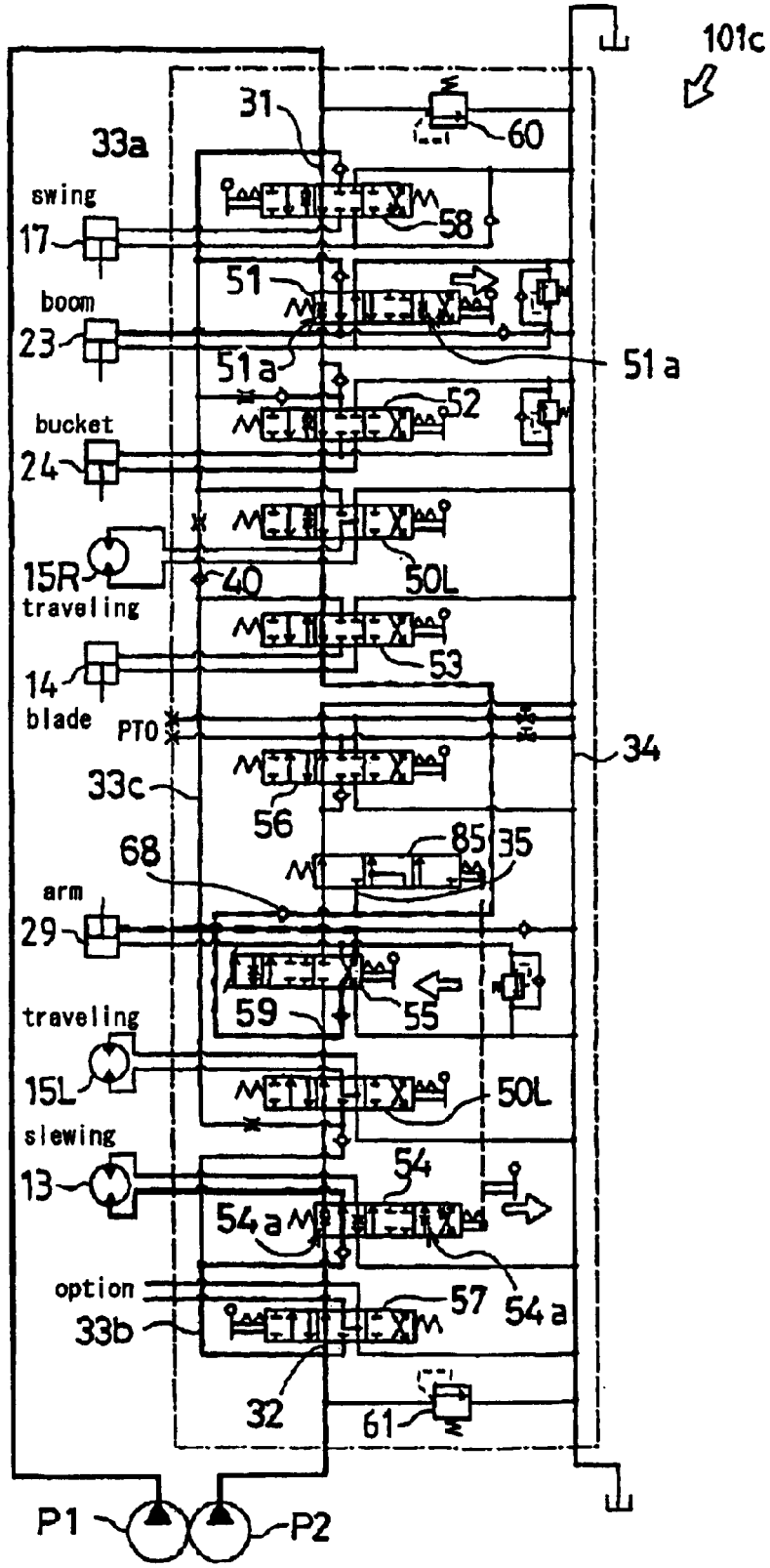
FIG. 24 is a circuit diagram of the hydraulic circuit 101*c*, showing a state thereof where the boom directional control valve 51, the arm directional control valve 55 and the slewing directional control valve 54 are set to their actuating positions.

Next, description will be given on a hydraulic circuit 101*c* as another embodiment enabled to carry out simultaneous triple-operation of the arm 5, the boom 6 and the slewing body 8 according to FIGS. 23 to 25. FIG. 23 shows a state of the hydraulic circuit 101*c* where all the directional control valves are set to their neutral positions. FIG. 24 shows a state of the hydraulic circuit 101*c* where the boom directional control valve 51, the arm directional control valve 55 and the slewing directional control valve 54 are set to their actuating positions. FIG. 25 shows a list about the applicability of simultaneous activity among the arm 5, the bucket 4 and the boom 6 and the slewing body 8 with regard to the hydraulic circuit 101*c*.

The hydraulic circuit 101*c* employs the characteristics of the hydraulic circuit 101*a* and the hydraulic circuit 101*b* efficiently. In this regard, the P port and the T port of the boom directional control valve 51 on the first center bypass oil passage 31 are connected with each other through the bleed orifice 51*a* when the boom directional control valve 51 is in its actuating position. The P port and the T port of the slewing directional control valve 54 on the second center bypass oil passage 32 are connected with each other through the bleed orifice 54*a* when the slewing directional control valve 54 is in its actuating position. Other parts of the construction are the same as those of the hydraulic circuit 101.

As shown in FIG. 24, surplus flow to the flow of pressure oil supplied to the boom cylinder 23 from the first hydraulic pump P1 and surplus flow to the flow of pressure oil supplied to the slewing motor 13 from the second hydraulic pump P2 are supplied to the arm cylinder 29 so as to drive the arm 5.

With regard to the hydraulic circuit 101*c*, the applicability of simultaneous activity among the arm 5, the bucket 4, the boom 6 and the slewing body 8 becomes as shown in FIG. 25. When the three directional control valves are switched to their actuating positions so as to drive the three of the boom 6, the arm 5 and the slewing body 8, the arm cylinder 29 is supplied with the above-mentioned surplus flows of hydraulic oil from the pumps P1 and P2. Accordingly, pressure oil from the pumps is substantially equally divided into three parts and supplied to the respective three actuators so as to simultaneously drive all the three actuators satisfactorily.

Due to this construction, the hydraulic circuit 101*c* of two pump system matches up the simultaneous triple activity of the arm 5, the boom 6 and the slewing body 8 to the simultaneous triple activity thereof of a hydraulic circuit of three pump system.

Figure 26:
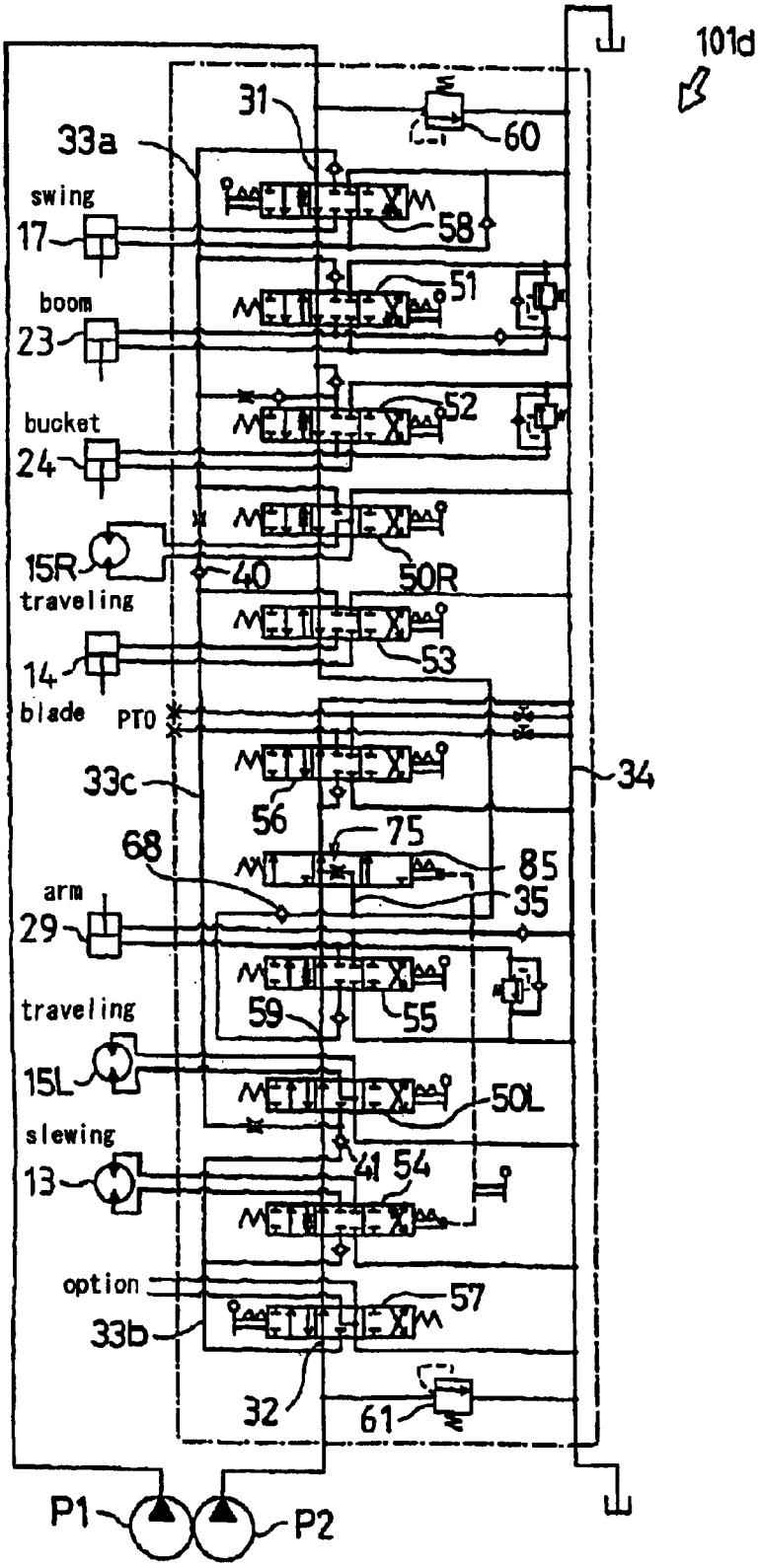
FIG. 26 is a circuit diagram of a hydraulic circuit 101*d*, wherein the bleed switching valve 85 is formed therein with an orifice 75, showing a state thereof where all the directional control valves are set to their neutral positions.
Figure 27:
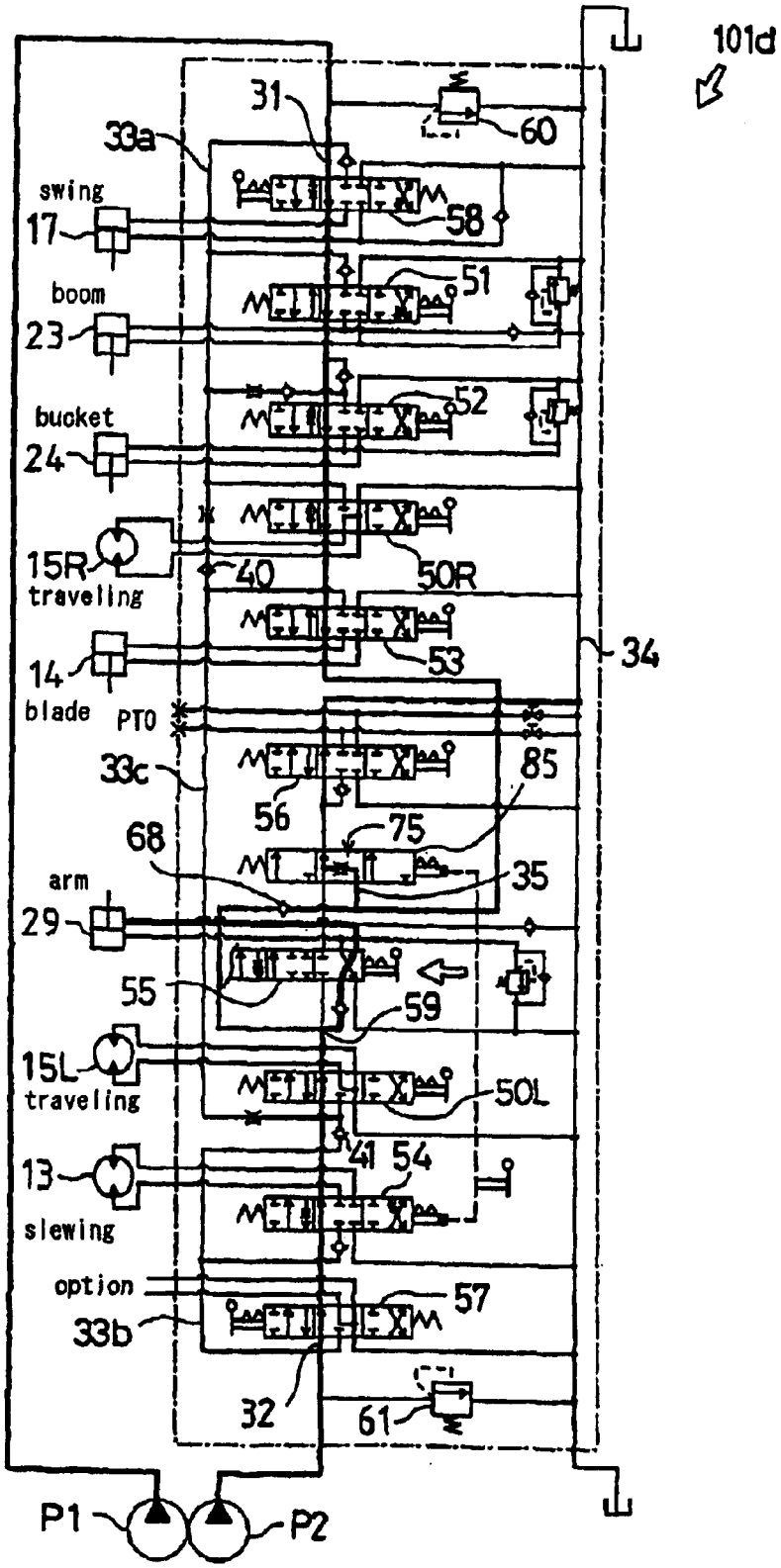
FIG. 27 is a circuit diagram of the hydraulic circuit 101*d*, showing a state thereof where the arm directional control valve 55 is set to its actuating position.

A hydraulic circuit 101*d* shown in FIGS. 26 and 27 serves as a hydraulic circuit 101 having the bleed switching valve 85 which is modified to have the orifice 75 as shown in the hydraulic circuit 100 so as to improve the activity of the arm 5. FIG. 26 shows a state of the hydraulic circuit 101*d* here all the directional control valves are set to their neutral positions. FIG. 27 shows a state of the hydraulic circuit 101*d* where the arm directional control valve 55 is set to its actuating position.

With regard to the hydraulic circuit 101*d*, the orifice 75 is disposed in the bleed switching valve 85 of the hydraulic circuit 101. One end of the orifice 75 is connected to the bleed oil passage branching from the first center bypass oil passage 31, and the other end thereof to the second center bypass oil passage 32 passing the bleed switching valve 85 (the confluent passage thereof with the first center bypass oil passage 31).

The same effect can be obtained by disposing the orifice 75 in the bleed oil passage 35 on the upstream of the bleed switching valve 85. However, if the orifice 75 is provided in the bleed switching valve 85 similarly with the case of the hydraulic circuit 101*b* as a modification of the hydraulic circuit 101 (sic), it can be formed in a spool connecting ports therein. Further, the opening of the orifice 75 can be adjusted only by exchanging the spool. With regard to the boom directional control valve 151 and the slewing directional control valve 154 of the hydraulic circuits 101*a*, 101*b* and 101*c*, the same construction is applicable.

Due to this construction, as shown in FIG. 27, when only the arm directional control valve 55 is set to its actuating position, pressure oil from the second hydraulic pump P2 is supplied to the arm cylinder 29 through the arm directional control valve 55. Simultaneously, some of pressure oil from the first hydraulic pump P1 flows out to the downstream side of the arm directional control valve 55 through the bleed oil passage 35 and the orifice 75 within the bleed switching valve 85 before reaching the neutral connection portion. The orifice 75 restricts the amount of this outflow of hydraulic oil. The remaining of pressure oil of the first center bypass oil passage 31 reaches to the neutral connection portion 59 and joins to pressure oil from the second hydraulic pump P2 so as to be supplied to the arm cylinder 29 through the arm directional control valve 55.

Namely, the orifice 75 within the bleed switching valve 85 allows a part of pressure oil from the first hydraulic pump P1 to be supplied to the arm cylinder 29. With regard to a hydraulic circuit, such as the hydraulic circuit 101, having no orifice, the arm cylinder 29 is substantially driven by pressure oil from only the second hydraulic pump P2 because most pressure oil from the first center bypass oil passage 31 flows out through the bleed oil passage 35 and the bleed switching valve 185 before reaching the neutral connection portion 59. Compared with this case, drive speed of the arm 5 of the hydraulic circuit 101*d* is faster.

The bleed switching valve 84 including the orifice 75 is also applicable to the above-mentioned hydraulic circuits 101*a*, 101*b* and 101*c* so that these hydraulic circuits can obtain the arm 5 improved in activity as effect of the orifice 75.

Figure 28:
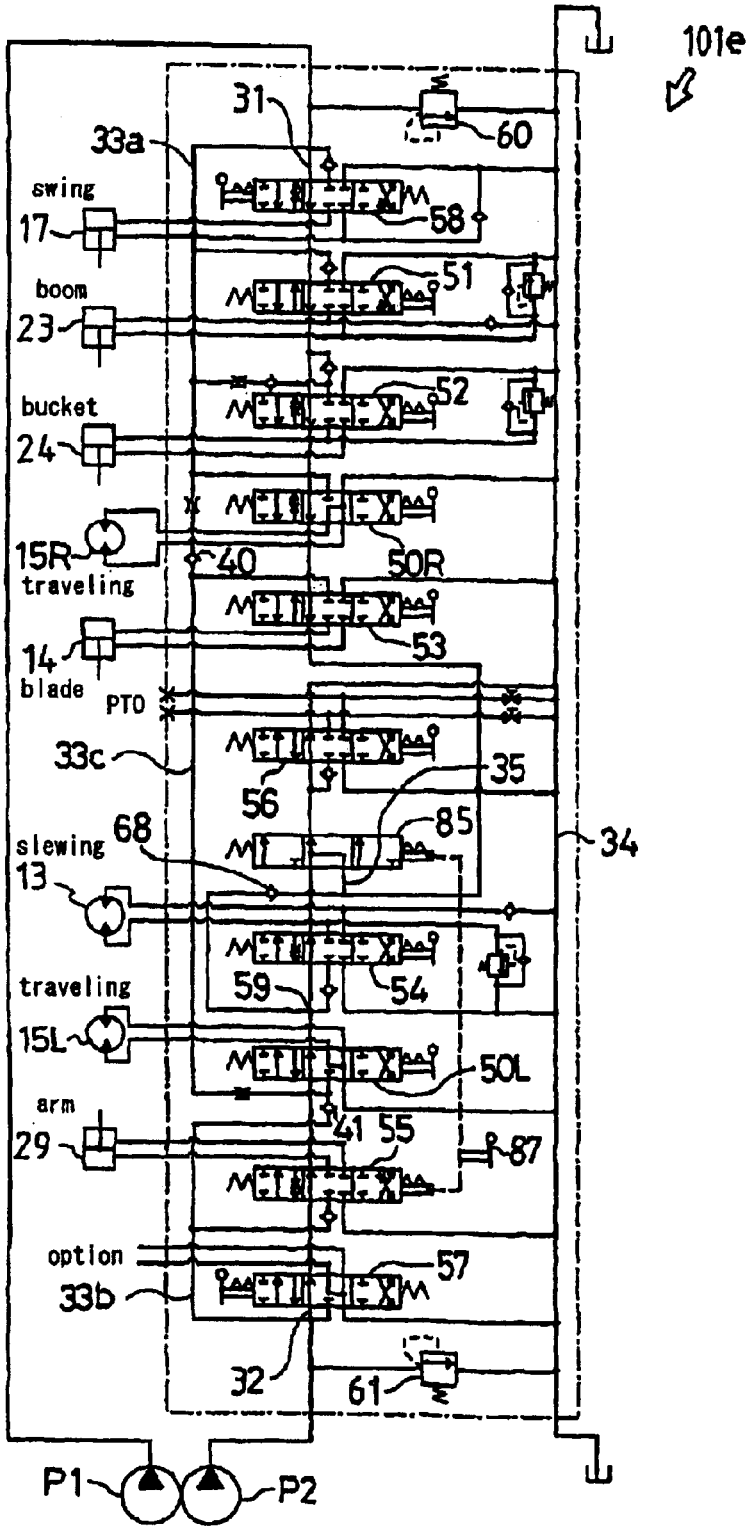
FIG. 28 is a circuit diagram of a hydraulic circuit 101*e* having the slewing directional control valve 54 and the arm directional control valve 55 exchanged.

The slewing directional control valve 54 and the arm directional control valve 55 in each of the above hydraulic circuits may be so exchanged in location as to be arranged similarly with those of a hydraulic circuit 101*e* shown in FIG. 28. Especially, when requiring large force for driving the slewing body 8 alone, the slewing directional control valve 54 and the arm directional control valve 55 may be exchanged in the hydraulic circuit 101*d* including the bleed switching valve 85 with the orifice 75, as shown in FIGS. 26 and 27, so that a considerable amount of pressure oil from the first hydraulic pump P1 in addition to the pressure oil from the second hydraulic pump P2 flows into the slewing motor 13.

Referring to the hydraulic circuit 101*e*, on second center bypass oil passage 32, the arm directional control valve 55 is disposed on the upstream of the slewing directional control valve 54 with the left traveling directional control valve 50L therebetween. The neutral connection portion 59, which is the confluence point of the second center bypass oil passage 32 and the first center bypass oil passage 31, is provided between the stewing directional control valve 54 and the left traveling directional control valve 50L adjoining to the valve 54 on the upstream side.

Such an exchange of hydraulic supply positions for the slewing motor 13 and the arm cylinder 29 is also applicable to the above mentioned hydraulic circuits 101*a* to 101*d*.

In this way, the hydraulic oil supply positions of actuators such as motors and cylinders may be exchanged so as to change an actuator to be improved in activity, Especially, the hydraulic oil 101*c* is so constructed as to equalize the activities of three simultaneously operated actuators. The three actuators are the arm cylinder 29 for the arm 5, the bucket cylinder 24 for the bucket 4, and the slewing motor 13 for the slewing body 8. Therefore, however hydraulic supply positions may be exchanged among the three actuators, the three actuators can be simultaneously operated with equal activities.

Finally, description will be given on hydraulic circuits 101*f* and 101*g* shown in FIGS. 29 and 30, as modifications of the hydraulic circuit 101 wherein the boom directional control valve 51, the bucket directional control valve 52, the arm directional control valve 55, the slewing directional control valve 54 and the bleed switching valve 85 are replaced with hydraulic pressure pilot directional control valves.

Figure 29:
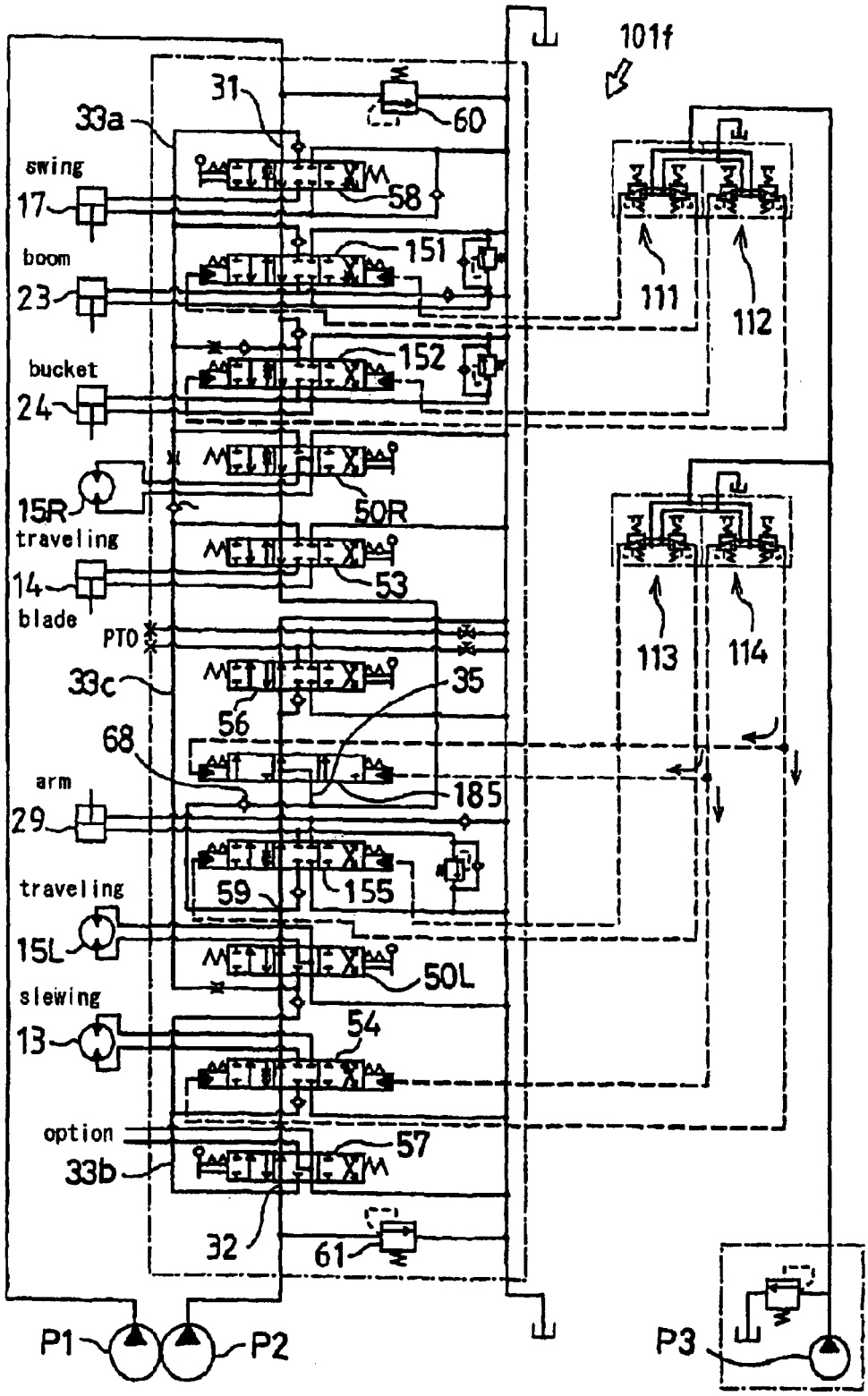
FIG. 29 is a circuit diagram of a hydraulic circuit 101*e*, wherein the boom directional control valve 51 (sic), the bucket directional control valve, the slewing directional control valve 54, the arm directional control valve 55 and the bleed switching valve are replaced with hydraulic pilot control valves, and the slewing directional control valve 54 and the bleed switching valve are modified to receive hydraulic pilot from the same pilot operation valve.

In the hydraulic circuit 101*f* shown in FIG. 29, a boom directional control valve 151, a bucket directional control valve 152, a bleed switching valve 185, an arm directional control valve 155 and a slewing directional control valve 154 are directional control valves which are operated with hydraulic pressure pilot.

A boom pilot operation valve 111, a bucket pilot operation valve 112, an arm pilot operation valve 113 and a slewing pilot operation valve 114 as pilot operation valves for operating the directional control valves are disposed in the hydraulic circuit 101*f*. A pilot pump P3 for operating the operation valves is also disposed therein. Each of the directional control valves for the actuators is switched by operating the corresponding pilot operation valve.

Although the hydraulic circuit 101*f* includes three hydraulic pumps P1, P2 and P3, the hydraulic pump P3 has only a function as a pilot pump. Thus, the hydraulic circuit 101*f* is not a so-called hydraulic circuit of three pump system for an excavating-and-slewing working vehicle.

A pair of inward and outward pilot passages of the slewing pilot operation valve 114 are provided therefrom with respective branch pilot oil passages. One branching pilot oil passage is connected to an operation portion of the slewing directional control valve 154, and the other to an operation portion of the bleed switching valve 185.

Due to this construction, by operating the slewing pilot operation valve 114, pilot hydraulic pressure is supplied to the operation portions of the slewing directional control valve 154 and the bleed switching valve 185 so as to switch the valves 154 and 185 in cooperation with the valve 114. Both the directional control valves are surely operated because of their interlocking cooperation with the operated stewing pilot operation valve 114.

Figure 30:
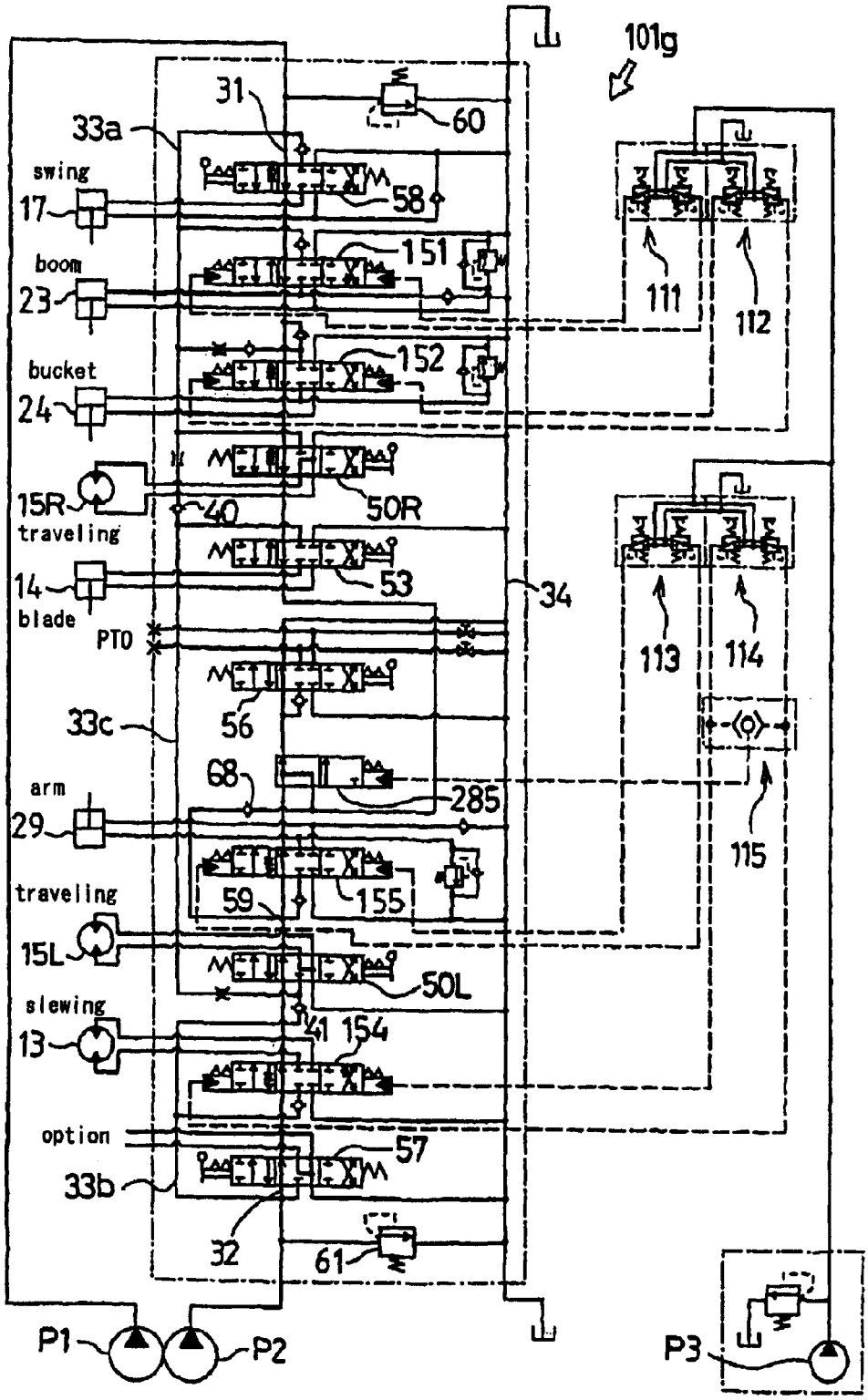
FIG. 30 is a circuit diagram of a hydraulic circuit 101*e*, wherein the bleed switching valve is further modified to receive hydraulic pilot from a high-pressure selection valve.

A bleed switching valve 285 with three ports and two switching positions is provided in the hydraulic circuit 101*g* shown in FIG. 30 instead of the bleed switching valve 185 with three ports and three switching positions. The pilot oil passages of the stewing pilot operation valve 114 are provided with a high-pressure selection valve (a shuttle valve) 115, from which a pilot oil passage branches to the pilot operation portion of the bleed switching valve 285. Other parts of the construction are the same as those of the hydraulic circuit 101*f*.

The high-pressure selection valve 115 is located across the inward and outward pilot oil passages connected to the secondary side of the slewing pilot operation valve 114. When pilot oil pressure in one of the inward and outward pilot oil passages is higher than the other, pilot oil pressure is applied from the higher pressure pilot oil passage to the pilot operation portion of the bleed switching valve 285 through the high-pressure selection valve 115 so as to set the bleed switching valve 285 to its actuating position. When the pilot oil pressure is equal between the inward and outward pilot oil passages, the bleed switching valve 285 returns to its neutral position by force of a spring provided in the valve 285.

Due to this construction, by operating the stewing pilot operation valve 114, the stewing directional control valve 154 and the bleed switching valve 185 are cooperatively switched. Both the directional control valves are surely operated because of their interlocking cooperation with the operated stewing pilot operation valve 114. Further, when the boom 6, the arm 5, the bucket 4 and the slewing body 8 are selectively operated simultaneously, they are satisfactorily balanced in activity.

The hydraulic pilot control valves as shown in FIGS. 29 and 30 may replace the directional control valves in any of the hydraulic circuits 101*a* to 101*e*.

As mentioned above to this point, the hydraulic circuit 101 is provided with the bleed switching valve 85 so as to open and close the bleed oil passage 35, thereby ensuring a large operation force of the arm 5 when being operated alone, and ensuring operation forces for the arm 5 and the stewing body 8 when they are operated simultaneously. This effect agrees with that given by the stewing directional control valve 54 incorporating the opening-and-closing bleed orifice, which is provided in each of the hydraulic circuits 100*a* and 100*b*. In other words, with regard to the foregoing modifications of the hydraulic circuit 101 (especially, the hydraulic circuit 101*d*), instead of the bleed switching valve 85, the stewing directional control valve 54 may be improved so as to incorporate a bleed circuit for operating the arm.

Furthermore, any of the hydraulic circuits 100, 100*a* and 100*b* may include the bleed orifice 51*a* in the boom directional control valve 51 or the bleed orifice 54*a* in the slewing directional control valve 54, as shown in the hydraulic circuits 101*a* to 101*c*, so that the boom 6, the arm 5 and the stewing body 8 can be simultaneously operated similarly with the hydraulic circuits 101*a* to 101*c*.

While the preferred embodiment of the invention has been described, it is further understood by those skilled in the art that the present disclosure of the preferred form has been changed in the details of construction and the combination and arrangement of parts may be resorted to without departing from the spirit and the scope of the invention as hereinafter claimed.

INDUSTRIAL APPLICABILITY

The foregoing present invention provides a hydraulic circuit of two pump system for an excavating-and-slewing working vehicle, having satisfactory roadability during work and satisfactory simultaneous operativity of two or more parts, thereby especially contributing to manufacture of a highly-efficient excavating-and-slewing working vehicle of a small size.

What is claimed is:

1. A hydraulic circuit of an excavating-and-slewing working vehicle, comprising:

actuators for a boom, a bucket, a blade, slewing, an arm and right and left traveling;

directional control valves for the respective actuators;

two hydraulic pumps delivering pressure oil to the actuators through the respective directional control valves, wherein one of the hydraulic pumps delivers hydraulic oil to the right traveling directional control valve for the right traveling actuator, and the other hydraulic pump to the left directional control valve for the left traveling actuator;

a pair of check valves for preventing pressure oil from flowing backward to the respective hydraulic pumps;

a confluent passage formed by mutually connecting delivery oil passages of the hydraulic pumps on the downstream of respective branch points of hydraulic oil supply passages to the right and left traveling directional control valves through the respective check valves; and parallel hydraulic oil supply passages branching from the confluent oil passage through respective orifices to inhalation ports of the respective directional control valves for the hydraulic actuators for boom, bucket, blade, slewing and arm.

wherein the branch point of the hydraulic oil supply passage to the blade directional control valve on the confluent oil passage is located on the substantially middle point between the branch points of the hydraulic oil supply passages to the right and left traveling directional control valves on the delivery oil passages of the hydraulic pumps.

2. A hydraulic circuit of an excavating-and-slewing working vehicle, comprising:

actuators for a boom, a bucket, slewing, an arm and right and left traveling;

directional control valves for the respective actuators;

two hydraulic pumps delivering pressure oil to the actuators through the respective directional control valves, wherein one of the hydraulic pumps delivers hydraulic oil to the right traveling directional control valve for the right traveling actuator, and the other hydraulic pump to the left directional control valve for the left traveling actuator;

a pair of check valves for preventing pressure oil from flowing backward to the respective hydraulic pumps;

a confluent passage formed by mutually connecting delivery oil passages of the hydraulic pumps on the downstream of respective branch points of hydraulic oil supply passages to the right and left traveling directional control valves through the respective check valves;

parallel first hydraulic oil supply passages branching from the confluent oil passage through respective orifices to inhalation ports of the respective directional control valves for the hydraulic actuators for boom, bucket, slewing and arm;

a pair of center bypass oil passages, wherein each of the center bypass oil passages branches from each of the delivery oil passages of the respective hydraulic pumps at the upstream of the corresponding check valve, and tandem-passes the directional control valves for boom, bucket, slewing and arm to an oil tank when the directional control valves for boom, bucket, slewing and arm are set in neutral; and second hydraulic oil supply passages also connected to the inhalation ports of the respective directional control valve for boom, bucket, slewing and arm, wherein each of the second hydraulic oil supply passages is connected to a portion of the corresponding center bypass oil passage on the primary side of the corresponding directional control valve.

3. The hydraulic circuit of an excavating-and-slewing working vehicle as set forth in claim 2, wherein one of the center bypass oil passages is enabled to tandem-pass the boom directional control valve for boom and the bucket directional control valve for bucket, and wherein, on the one center bypass oil passage and the confluent oil passage, branch points of the first and second hydraulic oil supply passages to the boom directional control valve are disposed on the respective upstream side of branch points of the first and second hydraulic oil supply passages to the bucket directional control valve.

4. The hydraulic circuit of an excavating-and-slewing working vehicle as set forth in claim 2, wherein one of the center bypass oil passages is enabled to tandem-pass the slewing directional control valve for slewing and the arm directional control valve for arm, and wherein, on the one center bypass oil passage and the confluent oil passage, branch points of the first and second hydraulic oil supply passages to the slewing directional control valve are disposed on the respective upstream side of branch points of the first and second hydraulic oil supply passages to the arm directional control valve.

5. The hydraulic circuit of the excavating-and-slewing working vehicle as set forth in claim 4, wherein the other center bypass oil passage is enabled to tandem-pass the boom directional control valve for boom and the bucket directional control valve for bucket, and wherein, on the other center bypass oil passage and the confluent oil passage, branch points of the first and second hydraulic oil supply passages to the boom directional control valve are disposed on the respective upstream side of branch points of the first and second hydraulic oil supply passages to the bucket directional control valve.

6. The hydraulic circuit of an excavating-and-slewing working vehicle as set forth in claim 2, wherein a first one of the center bypass oil passages is enabled to pass the arm directional control valve for arm, and wherein the other second center bypass oil passage is connected at the furthest downstream end thereof to the first center bypass oil passage on the primary side of the arm directional control valve.

7. The hydraulic circuit of an excavating-and-slewing working vehicle as set forth in claim 6, further comprising:

a second check valve interposed in the second center bypass oil passage on the upstream side of the furthest downstream end of the second center bypass oil passage; and a bleed oil passage branching from the second center bypass oil passage on the upstream side of the second check valve to the first center bypass oil passage on the downstream side of the arm directional control valve.

8. The hydraulic circuit of an excavating-and-slewing working vehicle as set forth in claim 7, further comprising:

an orifice interposed in the bleed oil passage.

9. The hydraulic circuit of an excavating-and-slewing working vehicle as set forth in claim 6, wherein the first center bypass oil passage is enabled to pass the slewing directional control valve for slewing on the upstream side of the arm directional control valve, wherein, on the first center bypass oil passage and the confluent oil passage, branch points of the first and second hydraulic oil supply passages to the slewing directional control valve are disposed on the respective upstream side of branch points of the first and second hydraulic oil supply passages to the arm directional control valve, and wherein the second center bypass oil passage is connected at the furthest downstream end thereof to the first center bypass oil passage between the slewing directional control valve and the arm directional control valve.

10. The hydraulic circuit of an excavating-and-slewing working vehicle as set forth in claim 6, further comprising:

a PTO directional control valve for PTO, wherein the first center bypass oil passage is enabled to pass the PTO directional control valve on the downstream side of the arm directional control valve, and wherein an inhalation port of the PTO directional control valve is connected to a hydraulic oil supply passage branching from the confluent oil passage.

11. The hydraulic circuit of an excavating-and-slewing working vehicle as set forth in claim 10, further comprising:

a second check valve interposed in the second center bypass oil passage on the upstream side of the furthest downstream end of the second center bypass oil passage; and a bleed oil passage branching from the second center bypass oil passage on the upstream side of the second check valve to the first center bypass oil passages between the arm directional control valve and the PTO directional control valve.

12. The hydraulic circuit of an excavating-and-slewing working vehicle as set forth in claim 11, further comprising:

an orifice interposed in the bleed oil passage.

* * * * *